US006874636B2

(12) United States Patent
Paliotta et al.

(10) Patent No.: US 6,874,636 B2
(45) Date of Patent: Apr. 5, 2005

(54) LOCK AND RELEASE MECHANISM OF CHILD RESISTANT UNIT DOSE PACKAGE

(75) Inventors: Michael Paliotta, Horseheads, NY (US); George Howell, Elmira, NY (US)

(73) Assignee: Howell Packaging, division of FM Howell & Co., Elmira, NY (US)

( * ) Notice: Subject to any disclaimer, the term of this patent is extended or adjusted under 35 U.S.C. 154(b) by 83 days.

(21) Appl. No.: 10/397,192

(22) Filed: Mar. 27, 2003

(65) Prior Publication Data

US 2004/0188311 A1 Sep. 30, 2004

(51) Int. Cl.[7] ..... B65D 83/04

(52) U.S. Cl. ..... 206/531; 206/1.5; 206/532; 229/125.125

(58) Field of Search ..... 206/531–532, 206/539, 1.5; 220/345.1, 345.2, 345.4; 229/125.125, 102

(56) References Cited

U.S. PATENT DOCUMENTS

| | | | | |
|---|---|---|---|---|
| 1,253,489 | A | | 1/1918 | Houghland |
| 3,186,542 | A | | 6/1965 | Greene |
| 3,215,332 | A | | 11/1965 | Bess |
| 3,332,600 | A | | 7/1967 | Guernsey |
| 3,568,827 | A | | 3/1971 | Haring |
| 3,610,410 | A | | 10/1971 | Seeley |
| 3,761,010 | A | | 9/1973 | Rosenburg, Jr. |
| 3,888,350 | A | | 6/1975 | Horvath |
| 3,987,891 | A | | 10/1976 | Horvath |
| 4,007,828 | A | | 2/1977 | Mayled |
| 4,113,098 | A | | 9/1978 | Howard |
| 4,120,400 | A | | 10/1978 | Kotyuk |
| 4,126,224 | A | | 11/1978 | Laauwe et al. |
| 4,192,422 | A | | 3/1980 | Kotyuk |
| 4,364,488 | A | | 12/1982 | Anjou |
| 4,401,210 | A | | 8/1983 | Anjou |
| 4,817,819 | A | | 4/1989 | Kelly |
| 4,940,016 | A | | 7/1990 | Heath |
| 5,275,291 | A | | 1/1994 | Sledge |
| 6,047,829 | A | | 4/2000 | Johnstone et al. |
| 6,230,893 | B1 | | 5/2001 | Karow |
| 6,412,636 | B1 | | 7/2002 | Jones et al. |
| 6,491,211 | B1 | * | 12/2002 | Evans et al. ..... 229/102 |
| 6,641,031 | B2 | * | 11/2003 | Evans et al. ..... 229/102 |
| 2004/0050748 | A1 | * | 3/2004 | Ehrlund ..... 206/538 |

* cited by examiner

*Primary Examiner*—Bryon P. Gehman
(74) *Attorney, Agent, or Firm*—Arent Fox PLLC

(57) ABSTRACT

A lock and release mechanism of a unit dose package has a cut away formed in the second panel of an outer sleeve of the package, the cut away having a pair of legs extending therefrom and defining a node therebetween. A cut line and a throat region are formed in an end flap of first and second side panels, respectively, of a slide card to bifurcate each end flap into first and second engaging segments. The first and second engaging segments engage an engaging surface of a cut away formed in a second panel of the outer sleeve to prevent the slide card from unintentionally sliding within the outer sleeve. A release feature is formed in the third panel of the outer sleeve. The first and second engaging segments are disengaged from the engaging surface of the cut away by depressing the node via the release feature.

19 Claims, 20 Drawing Sheets

LOCK AND RELEASE MECHANISM OF CHILD RESISTANT UNIT DOSE PACKAGE

BACKGROUND OF THE INVENTION

1. Field of the Invention

This invention relates to a unit dose package having a unique lock and release mechanism that prevents a sliding card from being unintentionally disengaged from an outer sleeve, wherein the unit dose package provides a user with access to the solid articles or products contained in the sliding card.

2. Description of the Related Art

It is common practice to use blister packages to package small solid articles or products which may be dispensed from the package by applying pressure to the blister to force the article or product from an individual blister or capsule through a rupturable membrane. Since this type of packaging is typically used for marketing medicines, the invention will be referred to herein with respect to a package particularly suitable for such use, but it should be understood that the package may be used for other products as well. Recently, a substantial effort has been directed toward providing packaging that contains sufficient impediments to prevent children from easily opening the package and gaining access to the package articles or products while still providing adults with easy access to articles or products contained therein.

For example, U.S. Pat. No. 3,610,410 to Seeley discloses a tamperproof reclosable sliding panel blister package 15 having a panel 17 and blister enclosure 19. The panel 17 includes a stationary back portion 23 and a working front portion 25. Half moon cut outs 26 and a crease 27 are provided in the stationary back portion 23 while a crease 29 and a sliding panel 31 are provided in the working front portion 25. The blister enclosure 19 is attached to the stationary back portion 23 of the panel 17.

A user withdraws the sliding panel 31 by bending rearwardly extending tab portion 51, which causes the creases 27 and 29 to function as hinges. To perform initial flexing, the user pushes tab portion 51 away from the stationary back portion 23 by passing a finger 53 through the cut out 26, thereby drawing the slide panel 31 outwardly. By drawing the slide panel 31 further outward, a port 34 formed in the stationary back portion 23 is exposed to permit the contents of the blister enclosure 19 to pass therethrough. Seeley discloses a tamperproof package that requires a substantial amount of dexterity on the part of the user, which may render the package difficult to open for the elderly.

In another example, U.S. Pat. No. 3,761,010 to Rosenburg, Jr. discloses a safety carton having a cut out lock. As shown in FIGS. 1 and 4–5, the carton includes a base 10 that slides within sleeve 20, which includes a central longitudinal opening 30 that overlaps a cut away 31. The cut away 31 in panel 26 of the sleeve 20 forms retaining straps 32, 33 such that when the slidable base 10 is positioned within the sleeve 20, the straps 32 and 33 lock the base 10 therein. See FIG. 3. To remove the base 10, a user deflects one of the straps 32 or 33 with an index finger in a direction indicated by arrow b while simultaneously pushing the base 10 upward in a direction indicated by arrow a through the opening 30 and cut away 31. See FIG. 5.

In yet another example, U.S. Pat. No. 4,120,400 to Kotyuk discloses a pill package having means for access that are basically hidden from view when the package is closed or locked. For example, the embodiments shown in FIGS. 1–10 show a sliding blister card 10 provided within a sleeve 12 wherein a tab 20 is locked by shoulders 38 of the shield 12 that engage notches 40 in the tab 20. See FIG. 4 for an enlarged view. The tab 20 has two arms that are biased toward each other in order to disengage or unlock the card 10 from the shield 12. FIGS. 1–5 show the tabs 20 in the front or back ends of the package while FIGS. 6–10 show the tabs 20' can be positioned on the sides as well. The embodiments appear to be otherwise similar in structure.

The embodiment shown in FIGS. 11–16 provides a rail 59 on an inner top panel 56 that extends inward toward the slide card 50. The card 50 has a track 60 that engages the rail 59. To disengage the rail 59 from the track 60, a user must squeeze the sides of the of the package as shown by the arrows 76 in FIG. 15. Another embodiment illustrated in FIGS. 17–26 provides a U-shaped track 92 with tabs 112 extending from the ends of each leg. The tabs 112 lockingly engage openings 114 in the slide card 90. As shown in FIG. 22, to disengage the tabs 112 from the openings 114, a user must twist the card 90 in a clockwise manner.

In another example, U.S. Pat. No. 5,275,291 to Sledge discloses a tablet dispenser having a button 56, 656, 756 of a slide card 26, 626, 726 pointing away from the card and upward toward an outer sleeve 12, 612, 712 to enter a relief zone 22, 622, 720 formed in the sleeve 12, 612, 712. The relief zone 22, 622, 720 is either another button configured to engage a button 56, 656, 756 of the slide card 26, 626, 726 or is an aperture or hole through which the button 56, 656, 756 extends. To disengage the card 26, 626, 726 from the sleeve 12, 612, 712 a user must either depress the button (if there is one) of the sleeve 12 or simply push the button 56, 656, 756 of the slide card if the relief zone 22, 622, 720 is simply an aperture.

In yet another example, U.S. Pat. No. 6,047,829 to Johnstone et al. discloses a unit dose package 150 having an outer sleeve 2 and inner slide card 100. As shown in FIGS. 1–3, the outer sleeve 2 has extension panels 4 and 8. Extension panel 4 is folded over and adhesively attached to extension panel 8. Extension panel 8 is then folded over side panel 10. As shown in FIGS. 6–9, the inner slide card 100 has an extension panel 106 that is folded over side panel 102.

Once fully assembled, a user can pull the inner slide card 100 within the outer sleeve 50 formed by the outer sleeve blank 2 until the extension 106 of the inner slide card 100 is caught and retained by the folded extension panels 4 and 8 of the outer sleeve 50. Folded extension panels 4 and 8 of the outer sleeve 50 and extension panel 106 of the inner slide card 100, which form part of the locking means of the Johnstone et al. unit dose package, prevent the inner slide card from being completely removed from the outer sleeve 50.

The locking means of the package 150 also includes a release button 30, cut away 14, node 16, extension panels 4, 8, and extension 106. After the slide card 100 is placed within the outer sleeve 50, the extension 106 extends past the opening 14 of the sleeve 50, springs up into the opening 14, and is biased against the node 16. Accordingly, if a user attempts to remove the slide card 100 from the sleeve 50, the extension 106 slides up along the opening 14 to prevent the slide card 100 from being removed from the sleeve 50. In order to deactivate the sliding movement of the extension 106 along the opening 14, the user pushes the release button 30 such that the extension 106 is pushed against the node 16 and below the opening 14, wherein the extension 106 is prevented from sliding through the opening 14. As shown in FIG. 5, the extension 106 is caught and retained by the extension panels 4 and 8.

In another example, U.S. Pat. No. 6,230,893 to Karow discloses an improvement over the above-described Johnstone package. In particular, Karow states the locking means disclosed by Johnstone et al. is susceptible to unintentional or accidental release, thereby rendering the package vulnerable to the efforts of children to gain access to the contents of the package. Karow states the improvement requires making the area of the node 16 slightly larger than the area of the release button 30.

As shown in FIG. 1, the Karow package has an outer sleeve 2 that includes extension panels 4 and 8, a glue area 6, side panels 10, 18 and 26, cut away areas 12 and 14, a node 16, legs 17, side panels 20 and 24, cut outs 21 and 28, end flaps 22 and 32, and a release button 30 formed within the side panel 26. The legs 17 are elongations in the cut away area 14 and are designed to prevent the entire length of the node 16 from deflecting wherein only the area of the node 16 between the legs 17 will deflect.

Karow explains that the improvement over the Johnstone et al. package described above resides in the feature wherein the area of the node 16 between the legs 17 is structured to be slightly larger than the size of the release button 30, which causes the node 16 to deflect only when the release button 30 is pressed. However, the Karow package is still susceptible to unintentional or accidental release so long as enough pressure is applied to the release button 30 so as to disengage the extension 106. Otherwise, the Karow package is substantially identical to the Johnstone et al. package and a description of the Karow package is omitted herefrom to avoid redundancy.

In yet another example, U.S. Pat. No. 6,412,636 to Jones discloses a unit dose packaging system that has a release feature identical to those of the Johnstone and Karow. Jones further includes structural panels 12*a*, 12*b*, and 14 which reduce the deformation of the side panels to release the locking mechanism, as may be achieved when the sides of the sleeve are squeezed. See FIG. 3. The structural panels 12*a*, 12*b*, and 14 form a false bottom that strengthens the package. Moreover, Jones includes a plastic film strip 26 that is adhered along the edges of panels 5, 7, and 15 and acts as a reinforcement of the edges of the outer sleeve 1 to prevent tear propagation. See FIG. 6.

SUMMARY OF THE INVENTION

It is an object of the invention to at least overcome the above-discussed deficiencies of the conventional child resistant packages and dispensers.

It is also an object of the invention to provide a child resistant unit dose package having a unique lock and release mechanism that prevents a slide card containing a blister package from unintentionally being slid and possibly removed from within an outer sleeve of the package.

The unit dose package having the lock and release mechanism includes an outer sleeve and slide card configured to slidably fit within the outer sleeve. The outer sleeve has first, second, and third panels, wherein the second panel is foldable over the first panel and the third panel is foldable over the second panel. The slide card has first, second, third, and fourth side panels, wherein the second and fourth side panel are foldable over the first and third side panels, respectively. The first side panel has an end flap extending away from a side edge and the second side panel has an end flap extending away from a side edge.

The lock and release mechanism includes a cut away formed in the second panel of the outer sleeve, the cut away having a pair of legs extending therefrom and defining a node therebetween. A cut line is formed in the end flap of the first side panel of the slide card, and bifurcates the end flap of the first side panel to define first and second engaging segments. A throat region is formed in the end flap of the second side panel of the slide card and bifurcates the end flap of the second side panel to define first and second engaging segments. The first and second engaging segments of the bifurcated end flaps of the first and second side panels engage an engaging surface of the cut away to prevent the slide card from unintentionally sliding within the outer sleeve. Release means are formed in the third panel of the outer sleeve such that the first and second engaging segments of the bifurcated end flaps of the first and second side panels are disengaged from the engaging surface of the cut away by depressing the node via the release means.

The release means may include an aperture, wherein the aperture has a lateral diameter (AD) that is less than a lateral distance (NW) between the legs defining the node.

The legs may be orthogonal relative to a bottom edge of the second panel of the outer sleeve. Furthermore, the aperture is disposed over the node and between the legs.

The cut line formed in the end flap of the first side panel of the slide card may have a width that is less than a width of the throat region formed in the end flap of the second side panel of the slide card. Also, the throat region formed in the end flap of the second side panel of the slide card may have a width that is greater than or equal to a width of the cut line formed in the end flap of the first side panel of the slide card.

The first and second engaging segments of the bifurcated end flaps of the first and second side panels may be any one of crown shaped, arcuate, rectangular, square, trapezoidal, and triangular.

Furthermore, the release means may be a pair of release buttons. Additionally, the legs may be oblique relative to the bottom edge of the second panel of the outer sleeve and the node may be bifurcated by a nodal cut line into first and second node portions. Each release button of the pair of release buttons may be disposed to overlap a corresponding leg and a corresponding one of the first and second node portions.

Moreover, the pair of release buttons may be depressed either sequentially or simultaneously so as to disengage the engaging segments from the engaging surface of the cut away.

The cut line formed in the end flap of the first side panel of the slide card may define another throat region having a width that is equal to a width of the throat region formed in the end flap of the second side panel of the slide card.

Additionally, a top edge of the first panel of the outer sleeve may include an extension panel extending away therefrom. The top edge may be a score line about which the extension panel is foldable onto the first panel of the outer sleeve. The extension panel may include an adhesive region provided thereon for adhering the extension panel onto the first panel of the outer sleeve. Furthermore, the extension panel of the first panel of the outer sleeve may also include a cut away.

Also, at least a portion of the first, second, and third panels of the outer sleeve may have a tear resistant material.

BRIEF DESCRIPTIONS OF THE DRAWINGS

Other objects and features of the invention will be better understood from the following description, with reference to the accompanying drawings, wherein.

DETAILED DESCRIPTION OF THE PREFERRED EMBODIMENTS

The first embodiment of the invention will now be explained.

Figure 1:
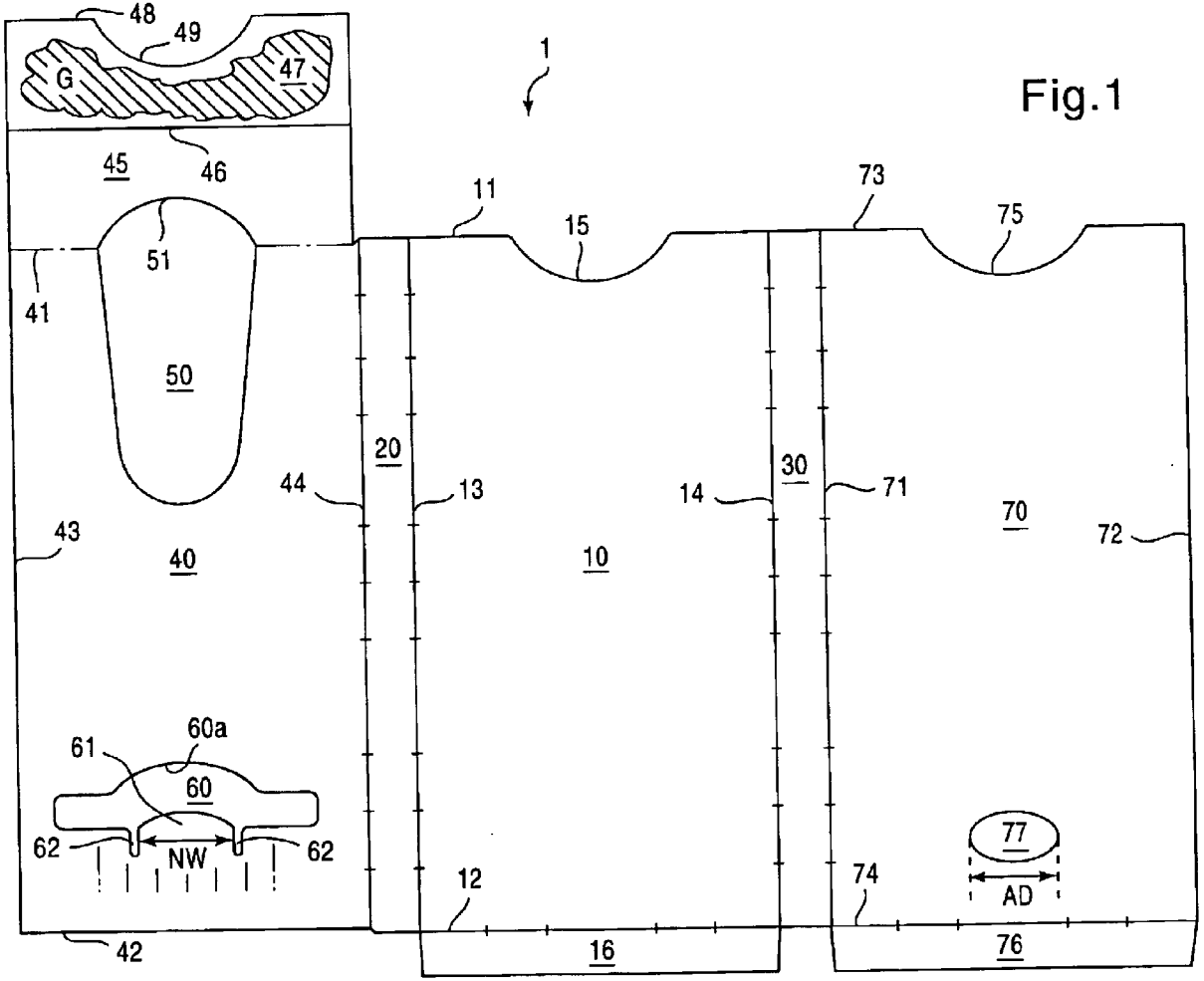
FIG. 1 is a top view of a disassembled outer sleeve of the package according to a first embodiment of the invention.

Referring to FIG. 1, the outer sleeve 1 of the package is formed from a flat, substantially rectangular shaped single blank, ideally made from paperboard. However, it is within the scope of this invention to use any suitable material well known or later developed in the art, such as, for example, paper, plastic, metal, natural or man made, and the like. Furthermore, although not illustrated but well understood in the art, it is within the scope of this invention to use any suitable geometric shape, such as, for example, square, trapezoidal, circular, oval, and the like to form the outer sleeve 1.

The outer sleeve 1 includes a first panel 10 separated from a second panel 40 by a first side panel 20. The first panel 10 and first side panel 20 are separated by score line 13 while the first side panel 20 is separated from the second panel 40 by score line 44. The first panel 10 is also separated from a third panel 70 by a second side panel 30. The first panel 10 is separated from the second side panel 30 by score line 14 while the second side panel 30 is separated from the third panel 70 by score line 71. The first panel includes a cut out 15 formed at a top edge 11 and an end flap 16 extending away from a bottom edge 12 of the first panel 10.

The second panel 40 includes a side edge 43 substantially parallel to and opposite score line 44. A score line 41 at a top edge of the second panel 40 is substantially parallel to and opposite a bottom edge 42 of the second panel 40. A second extension panel 45 is separated from the second panel 40 by score line 41 and extends away from the second panel 40. A first extension panel 47 is separated from the second extension panel 45 by score line 46 and extends away from the first expansion panel 45.

A cut out 49 is formed on a top edge 48 of the first extension panel 47. A substantial portion of a first cut away 50 is formed in the second panel 40 and partially formed in the second extension panel 45. Moreover, a second cut away 60 is formed in a region of the second panel 40 near the bottom edge 42. The second cut away 60 includes a node 61 defined by a pair of legs 62, 62, the legs being substantially orthogonal relative to the bottom edge 42 and prevent the entire length of the node 61 from deflecting. Also, the legs 62, 62 are elongations formed in the second cut away 60 and are substantially parallel to and opposite each other. The legs 62, 62 are separate from each other by a distance NW.

The third panel 70 includes a top edge 73 substantially parallel to and opposite a bottom edge 74. A cut out 75 is formed on the top edge 73 of the third panel 70 while an end flap 76 extends away from the bottom edge 74. An aperture 77 is formed near the bottom edge 74 of the third panel 70 and has a lateral diameter AD that is less than the lateral distance NW between the legs 62, 62 defining the node 61 on the second panel 40, i.e., NW>AD. In other words, when the third panel 70 is folded over the second panel 40, as will be explained below, the aperture 77 is disposed between the legs 62, 62 defining the node 61.

Furthermore, an adhesive region G having an adhesive is provided on either one of the first and second extension panel 47 and 45. Moreover, the adhesive may be any well known or later developed adhesive, such as, for example only, glue. The adhesive region G may cover the entire face of either extension panel 45 or 47 or provided on at least two separate locations of either panel 45 or 47, so long as one of the extension panels can be adhered to the other.

Figure 2:
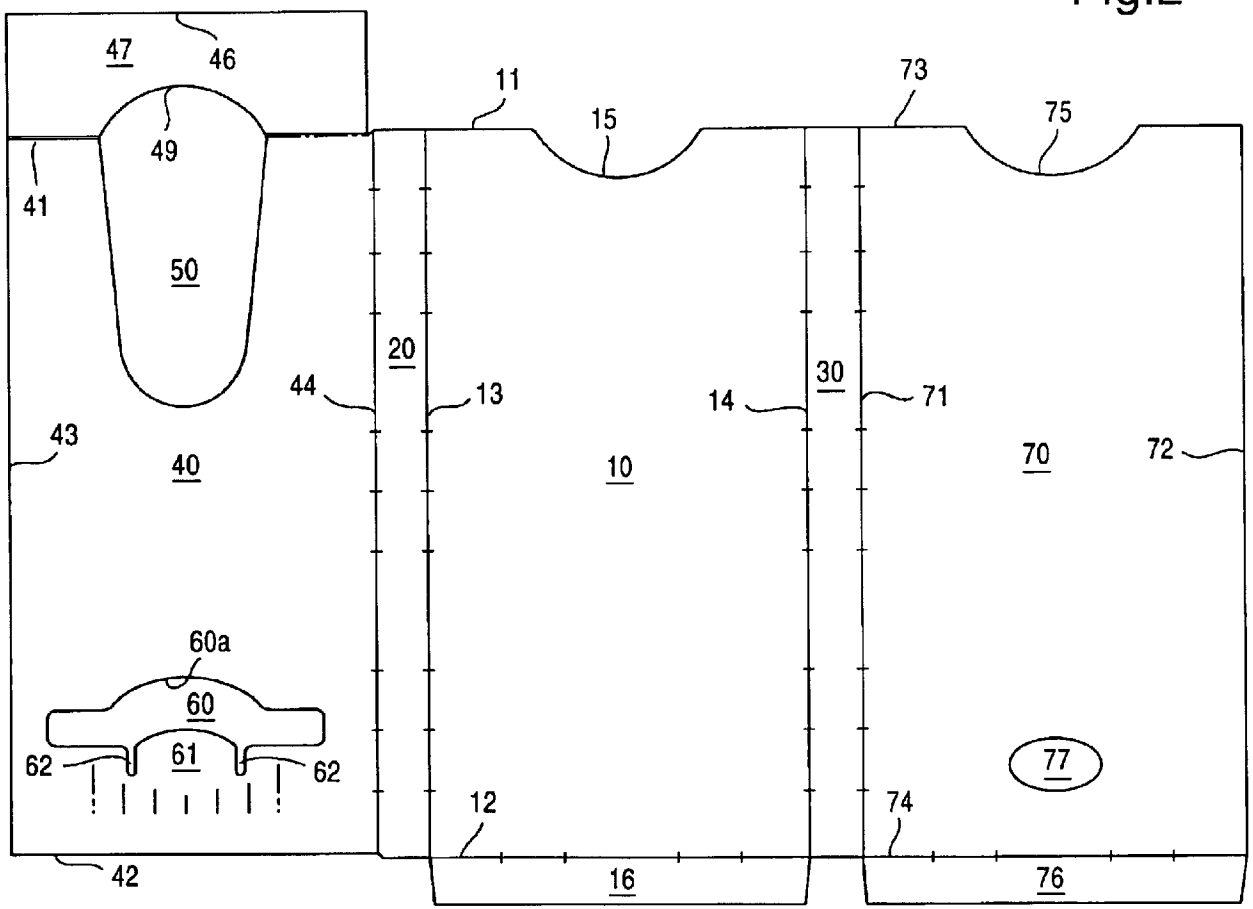
FIG. 2 is a top view of the package showing a first extension panel folded over a second extension panel of the outer sleeve of FIG. 1.
Figure 3:
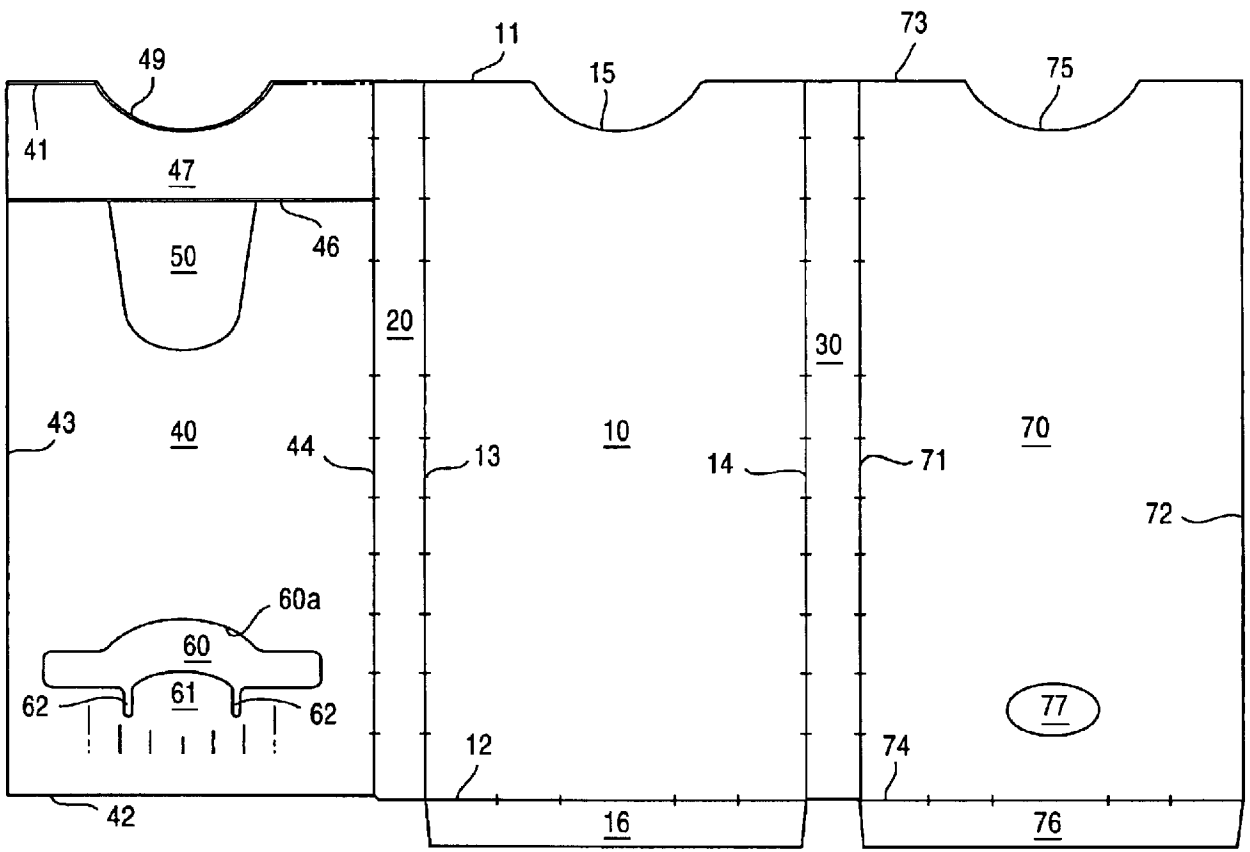
FIG. 3 is a top view of the package showing the second extension panel folded over a second panel of the outer sleeve of FIG. 2.
Figure 4:
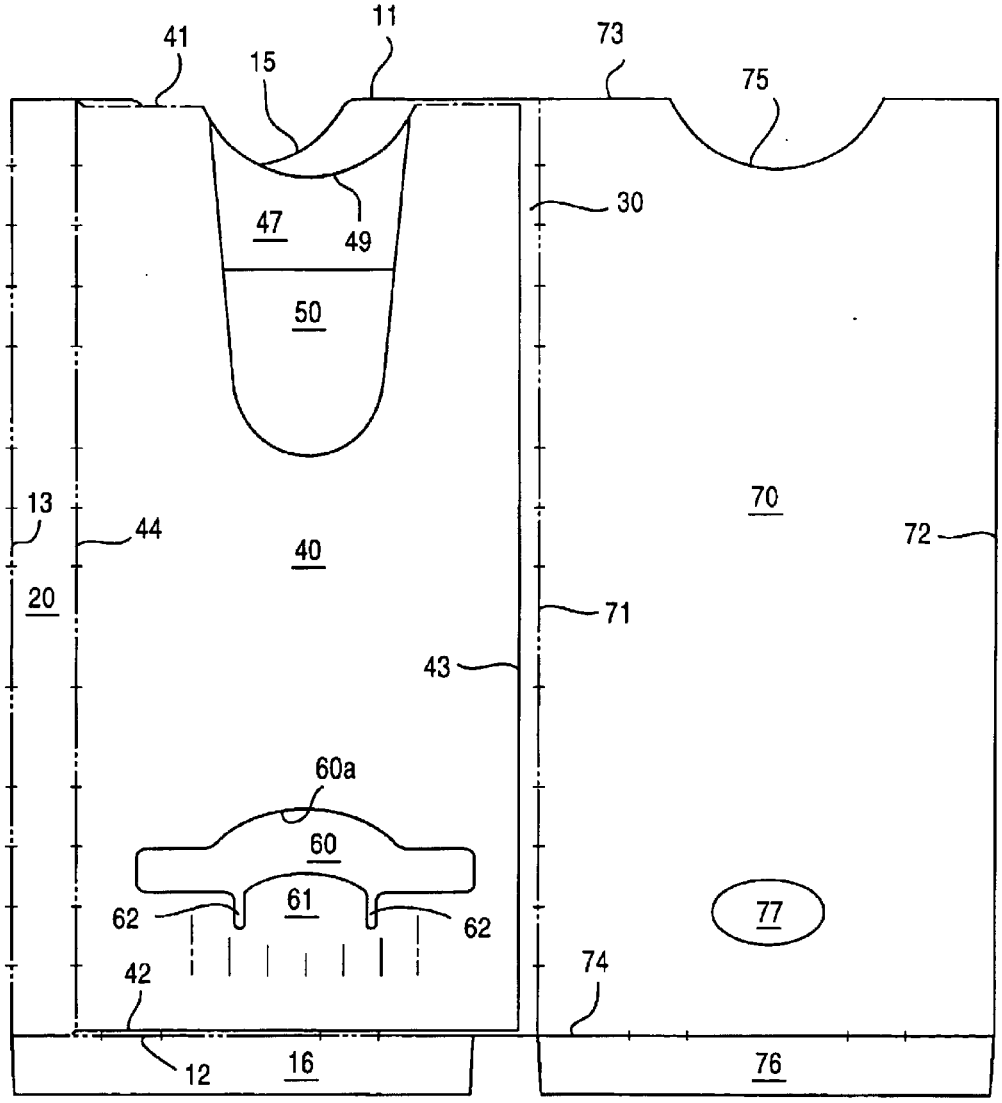
FIG. 4 is a top view of the package showing the second panel folded over a first panel of the outer sleeve of FIG. 3.
Figure 5:
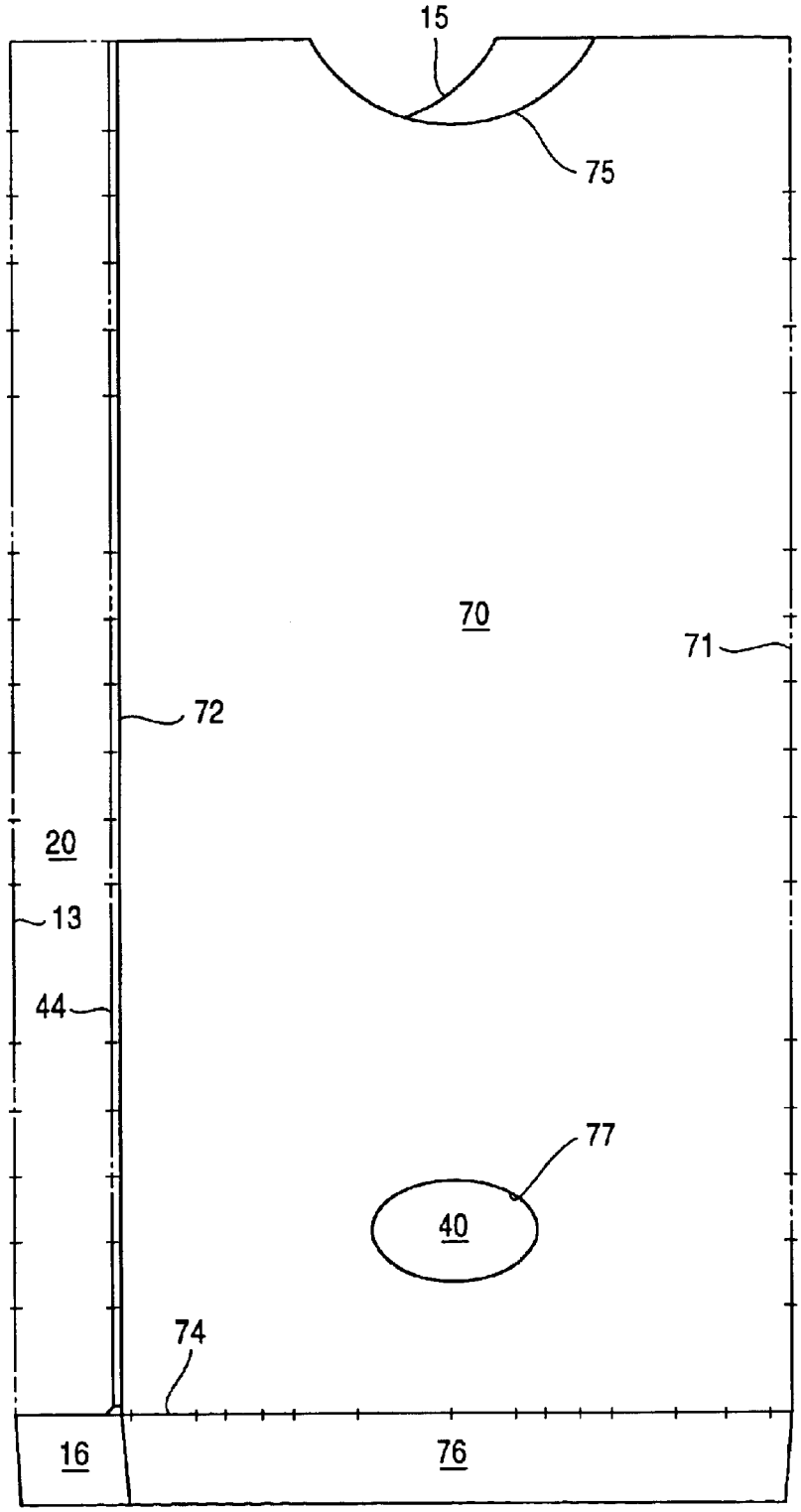
FIG. 5 is a top view of the package showing the third panel folded over the second panel of the outer sleeve of FIG. 4.

To form the outer sleeve 1, as shown in FIG. 2, the first extension panel 47 is folded over score line 46 and adhered to the second extension panel 45 such that the cut out 49 of the first extension panel overlaps a similarly configured cut out 51 formed on the second extension panel 45. The second extension panel 45 is folded over score line 41 onto the second panel 40 such that score line 41, top edge 11 of the first panel 10, and the top edge 73 of the third panel are coplanar, as shown in FIG. 3. Next, the side panel 20 is folded over score line 13 and the second panel 40 partially overlaps side panel 30, as shown in FIG. 4. The third panel 70 is folded over score line 71 and overlaps the second panel 40, wherein side edge 43 of the second panel 40 abuts the right angle corner formed by the third panel 70, first panel 10, and score line 71 when the third panel 70 bends over the score line 71 of the second side panel 30 as shown in FIG. 5.

Next, the end panel 16 is folded over the bottom edge 12 of the first panel 10 and the end panel 76 is folded over the bottom edge 74 of the third panel 70. The end panels 16 and 76 are affixed to each other via well known and conventional methods, such as, for example only, glue, to form the outer sleeve 1 shown in FIG. 5. As is evident form FIG. 5, because the third panel 70 is folded over the second panel 40 and the lateral diameter of the aperture 77 is less than a lateral distance between the legs 62, 62 defining the node 61, the node 61 and legs 62, 62 are not visible from above when the outer sleeve 1 is formed.

The completely constructed outer sleeve 1 includes the aperture 77 and extension panels 45 and 47. Accordingly, the folded over extension panels 45 and 47 function as a stopping mechanism that prohibits the inner slide card 100 (FIG. 6) from completely being pulled out of the sleeve 1. In particular, the extension panels 47 and 45 extend downward away from the second panel 40 and toward the first panel 10 to form the stopping mechanism.

Figure 6:
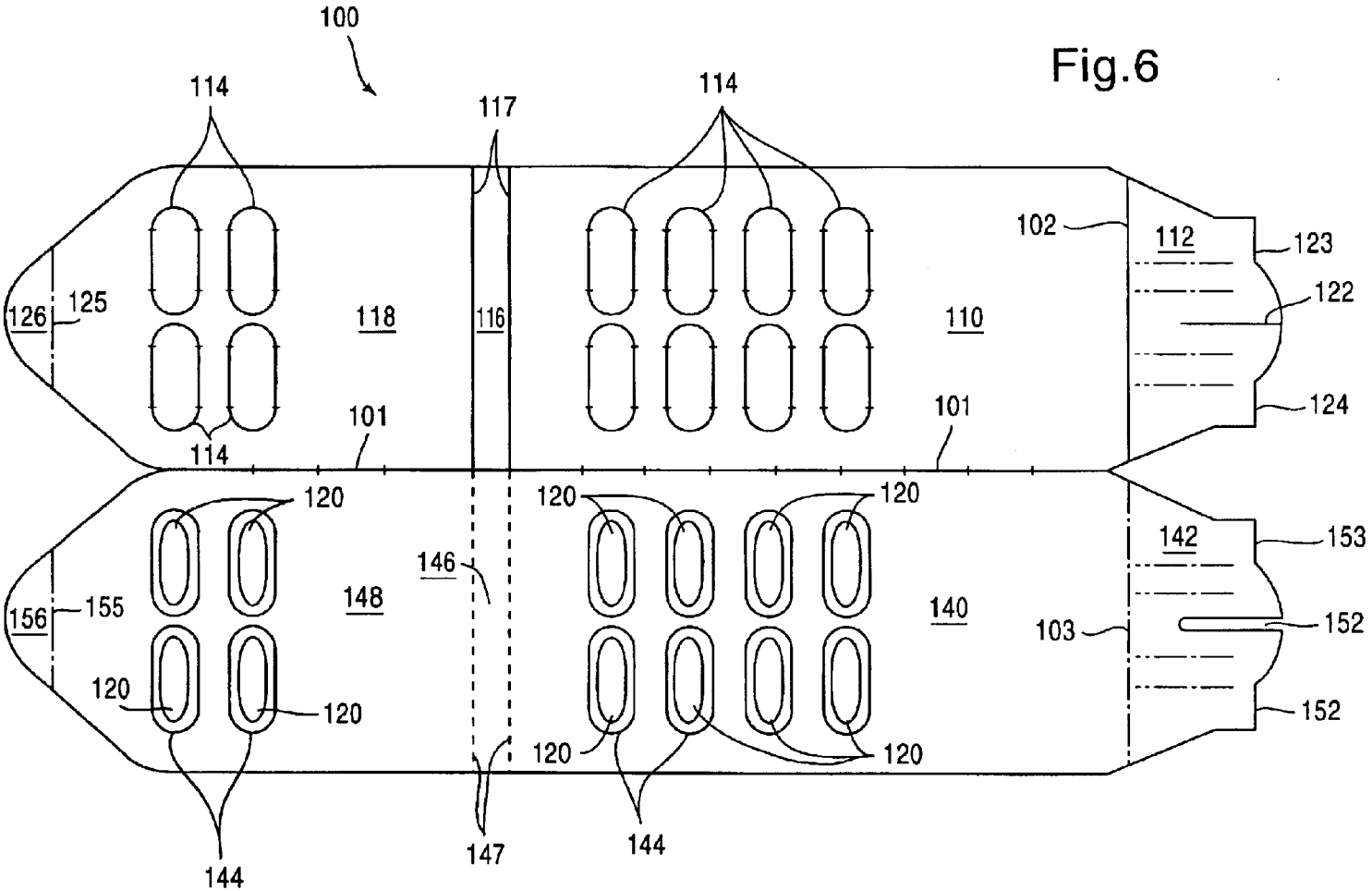
FIG. 6 is a top view of the disassembled slide card of the package according to a first embodiment of the invention.

Referring to FIG. 6, the inner slide card 100 is formed from a flat, substantially rectangular shaped single blank, ideally made from paperboard. However, it is within the scope of this invention to use any suitable material well known or later developed in the art, such as, for example, paper, plastic, metal, natural or man made, and the like. Furthermore, although not illustrated but well understood in the art, it is within the scope of this invention to use any suitable geometric shape, such as, for example, square, trapezoidal, circular, oval, and the like to form the inner slide card 100 so long as the slide card is compatible with the geometric configuration of the outer sleeve 1.

The slide card 100 includes a first side panel 110 separated from a third side panel 118 by an intermediate panel 116 defined by score lines 117, 117. A second side panel 140 is separated from a fourth side panel 148 by an intermediate panel 146 defined by perforated lines 147, 147. The first and third side panels 110 and 118 are separated from the second and fourth side panels 140 and 148, respectively, by score line 101. Moreover, the first and third side panels 110 and 118 include a plurality of perforated holes 114 through which the doses 120 are pushed by the user, as will be explained in further detail below. The second and fourth side panels 140 and 148 include a plurality of conventional unit dose packages 144, wherein each package 144 contains a unit dose 120.

A side edge of the first side panel 110 is defined by score line 102, which separates the side panel 110 from an end flap 112. A cut line 122 bifurcates the end flap 112 into first and second engaging segments 123 and 124, respectively. It should be noted that although the engaging segments 123 and 124 are illustrated as being crown shaped, it is within the scope of this invention that the engaging segments 123 and 124 may be any suitable geometric shape, such as arcuate, rectangular, square, trapezoidal, triangular, and the like. The particular geometric shape chosen from the engaging segments 123 and 124 must be selected so that they are able to engage and disengage the cut away 60 of the second panel 40. A side edge of the third side panel 118 opposite to the side edge of the first side panel 110 is tapered and defined by flex line 125 with a nose 126 extending away therefrom. The flex line 125 permits the nose 126 to bend but not fold over the flex line 125.

A side edge of the second side panel 140 is defined by score line 103, which separates the side panel 140 from an end flap 142. A throat 152 having a length substantially equal to the cut line 122 of end flap 112 and a width greater than or equal to a width of the cut line 122 bifurcates the end flap 142 into first and second engaging segments 153 and 154, respectively. It should be noted that although the engaging segments 153 and 154 are illustrated as being crown shaped, it is within the scope of this invention that the engaging segments 153 and 154 may be any suitable geometric shape, such as arcuate, rectangular, square, trapezoidal, triangular, and the like. The particular geometric shape chosen from the engaging segments 153 and 154 must be selected so that they correspond to the geometric shape of the engaging segments 123 and 124 and are able to engage and disengage the cut away 60 of the second panel 40. A side edge of the fourth side panel 148 opposite to the side edge of the second side panel 140 is tapered and defined by flex line 155 with a nose 156 extending away therefrom.

Figure 7:
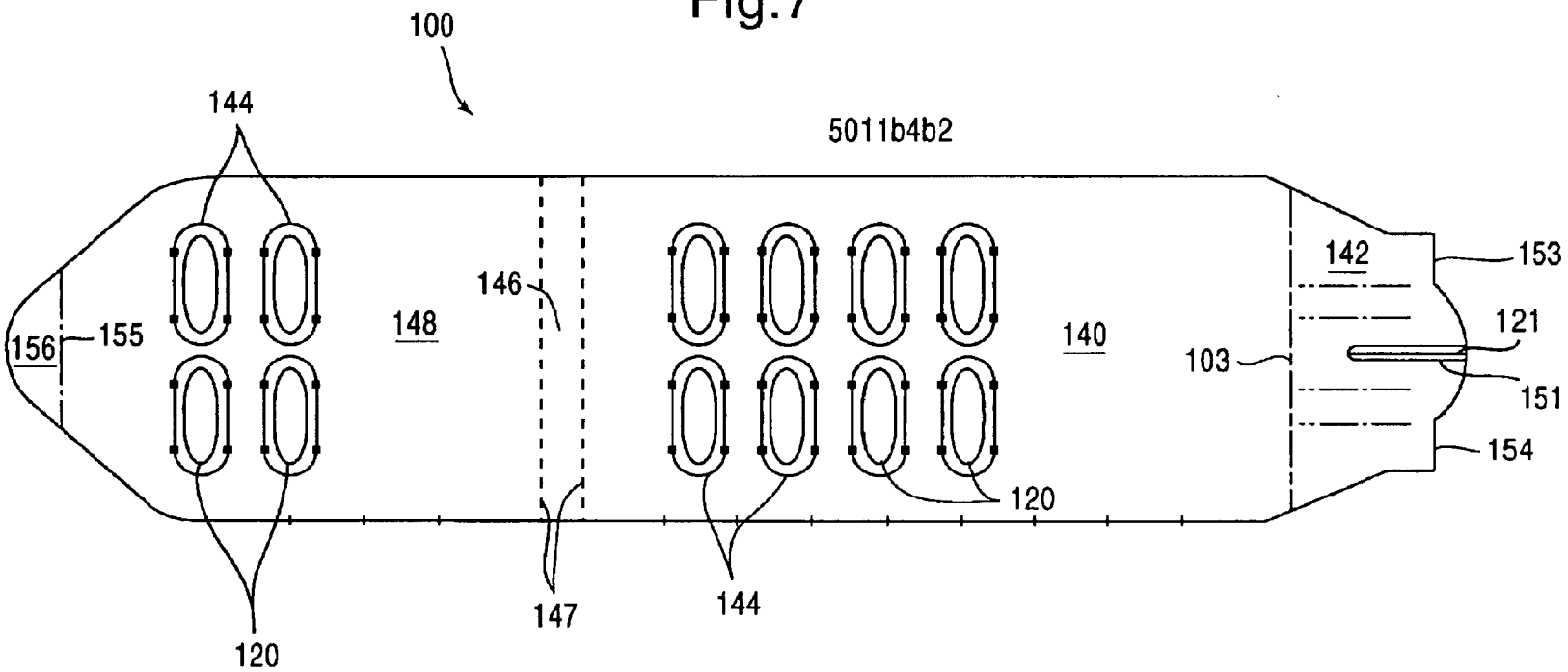
FIG. 7 is a top view of the of the slide card with a second slide panel folded over a first slide panel of the slide card of FIG. 6.

As shown in FIG. 7, the second and fourth side panels 140 and 148 are folded over score line 101.

Figure 8:
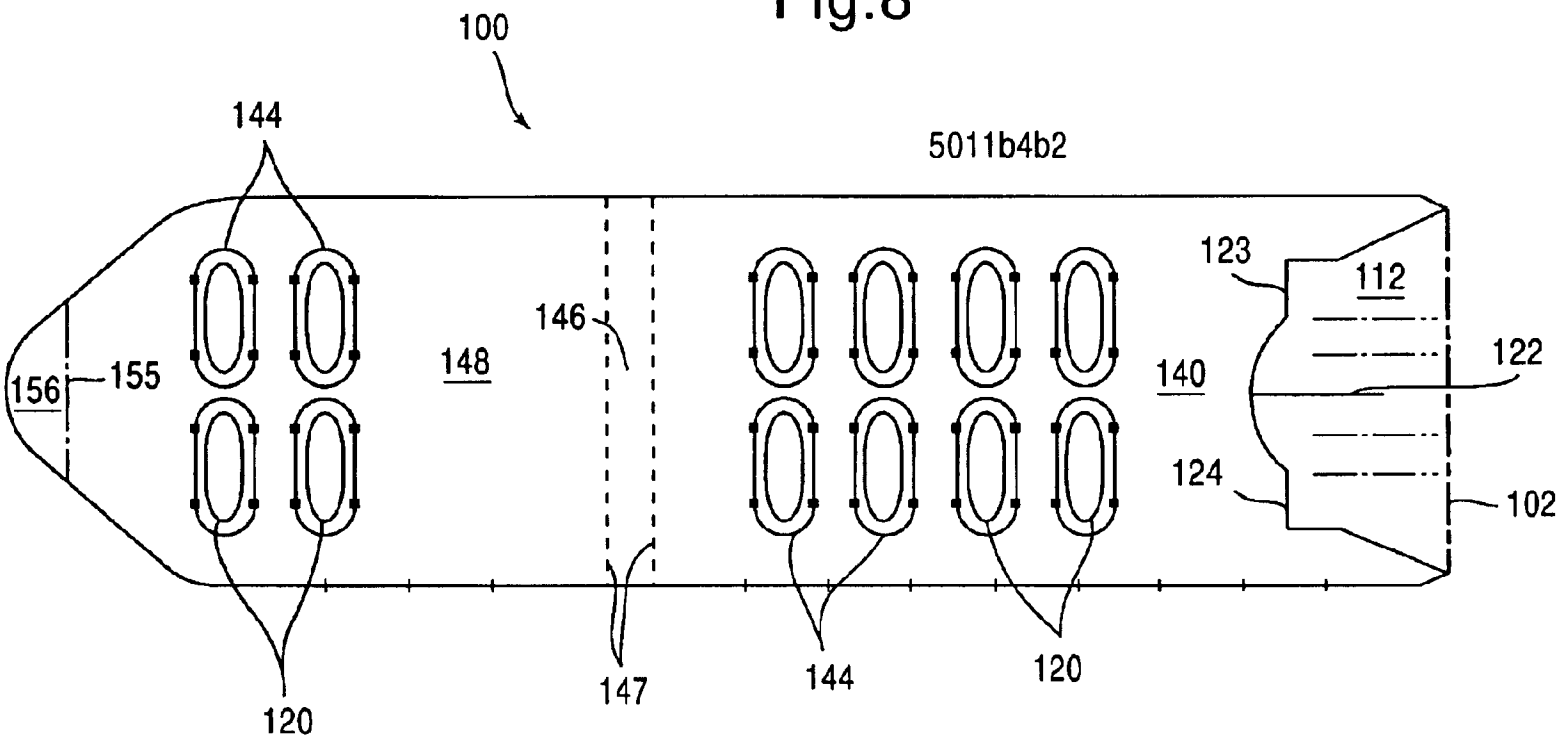
FIG. 8 is a top view of the slide card with a first end flap folded over the first slide panel of the slide card of FIG. 7.

Flap end 112 is folded over score line 102 to overlap at least a part of the second side panel 140 such that the engaging segments 123 and 124 of end flap 112 are closer to the second panel 140 than the engaging segments 153 and 154 of end flap 142. See FIG. 8. That is, the engaging segments 123 and 124 are on top of the engaging segments 153 and 154 when viewed from above.

Figure 9:
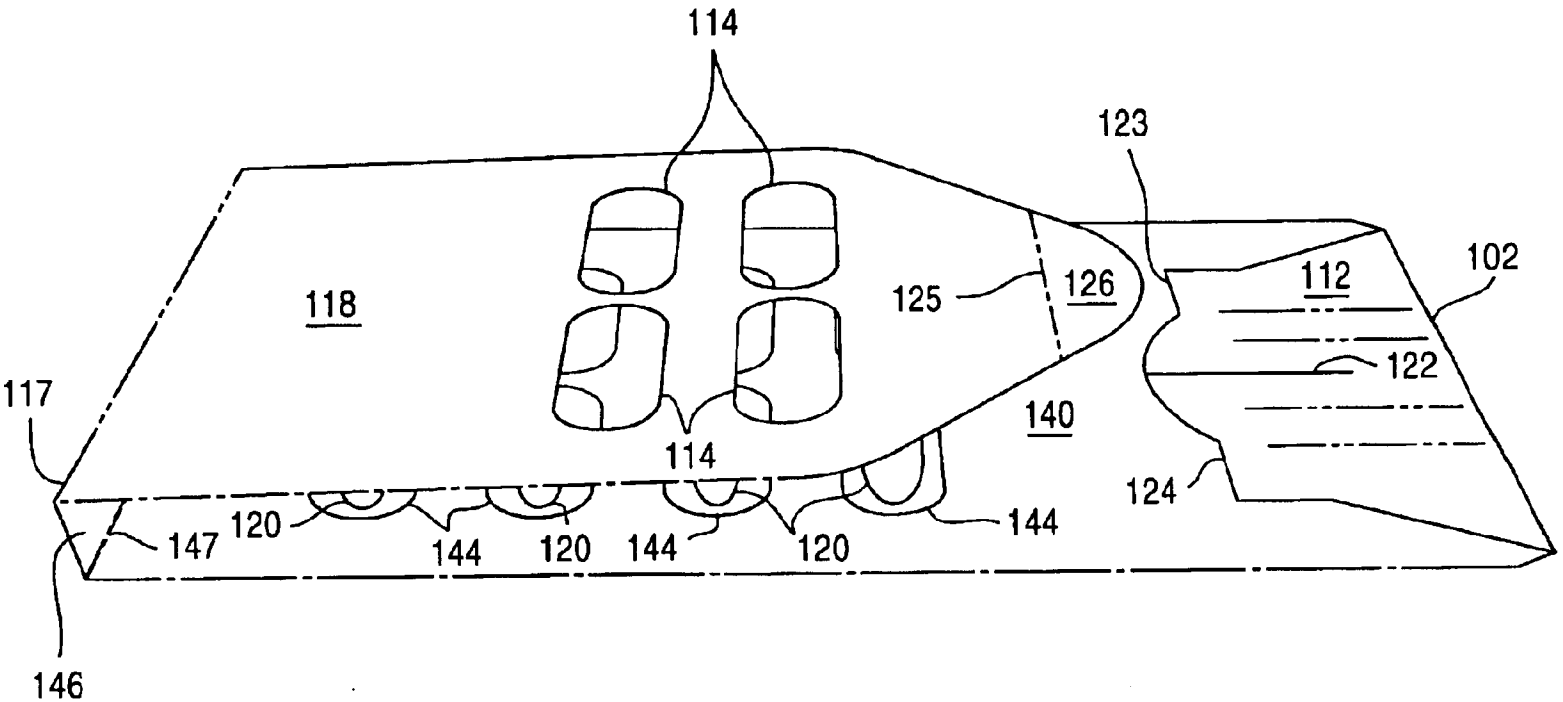
FIG. 9 is a top view of the slide card with a second end flap folded over the first slide panel of the slide card of FIG. 8.
Figure 10:
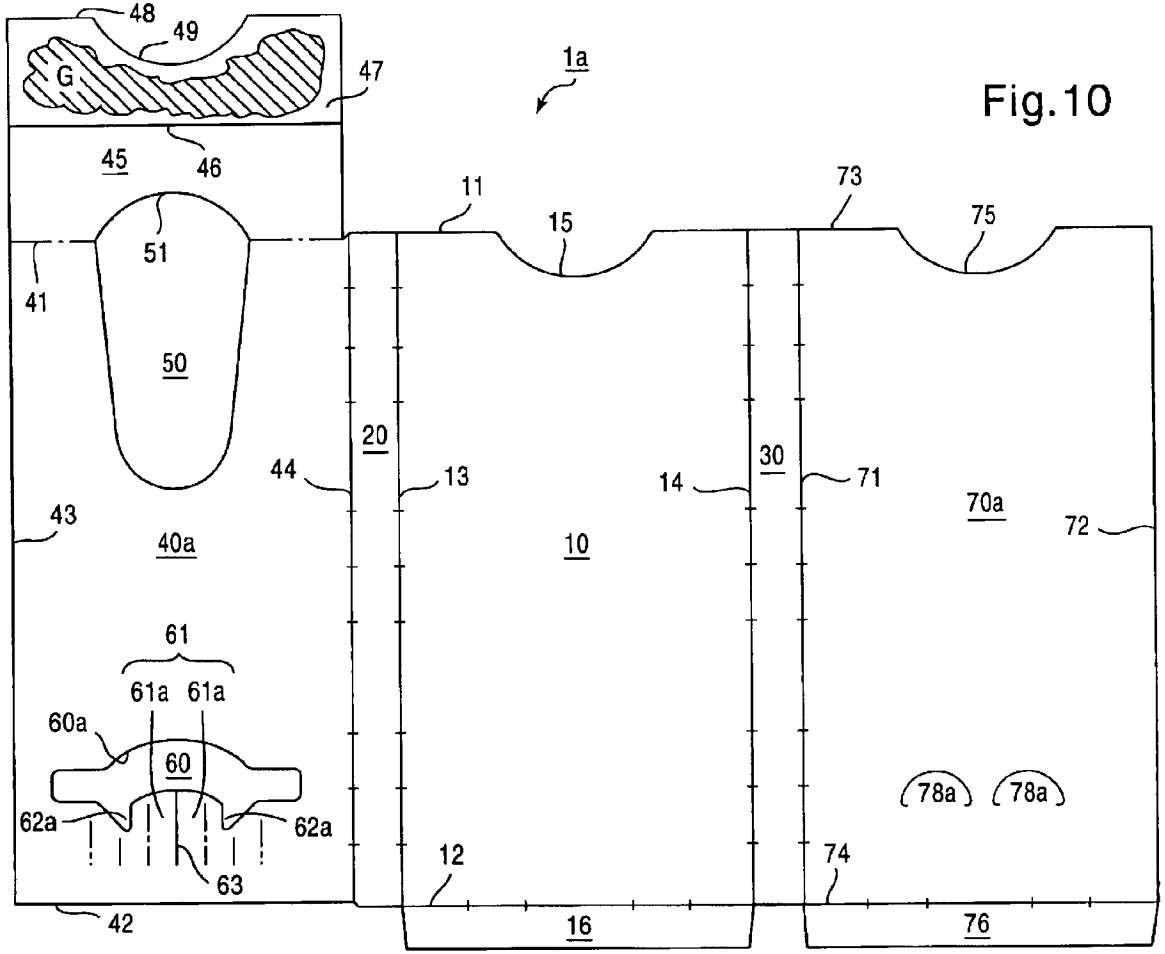
FIG. 10 is a top view of a disassembled outer sleeve of the package according to a second embodiment of the invention.
Figure 11:
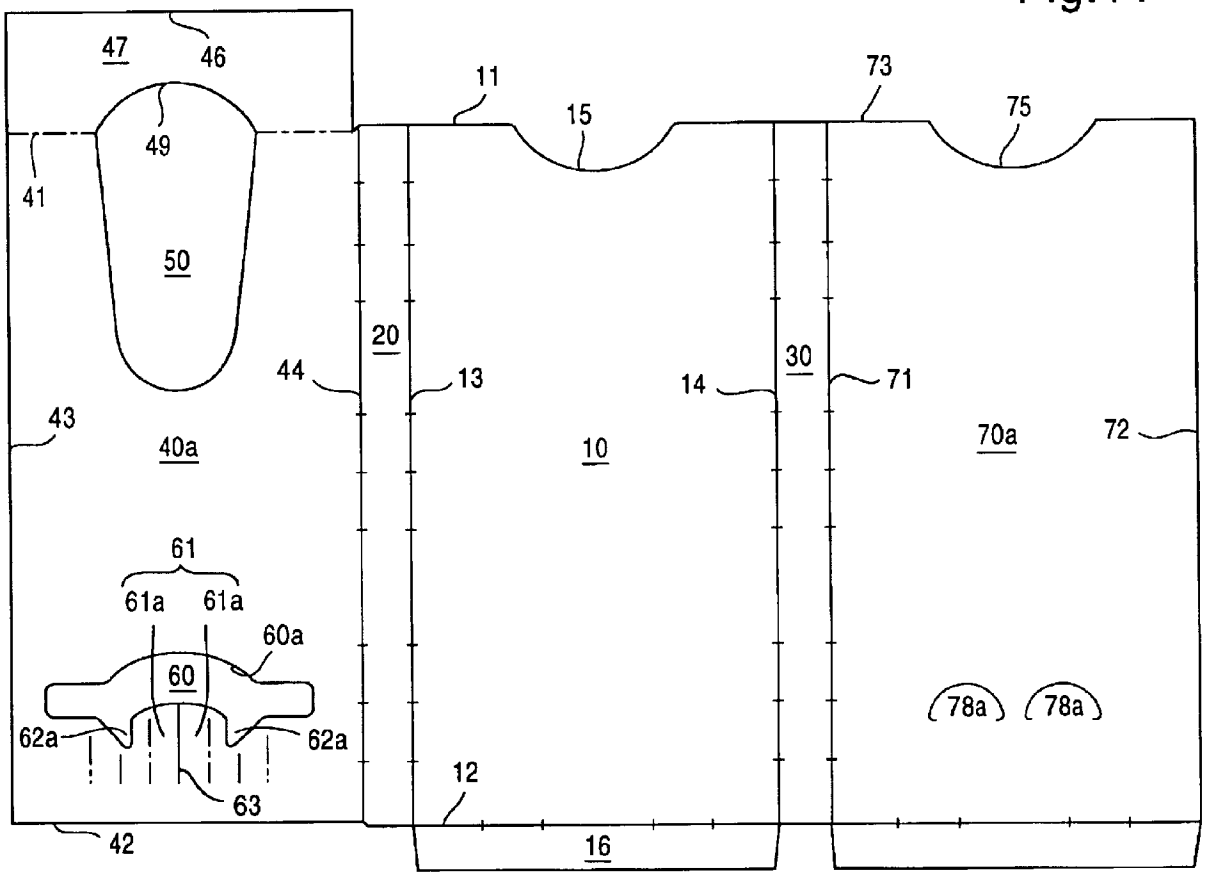
FIG. 11 is a top view of the package showing a first extension panel folded over a second extension panel of the outer sleeve of FIG. 10.
Figure 12:
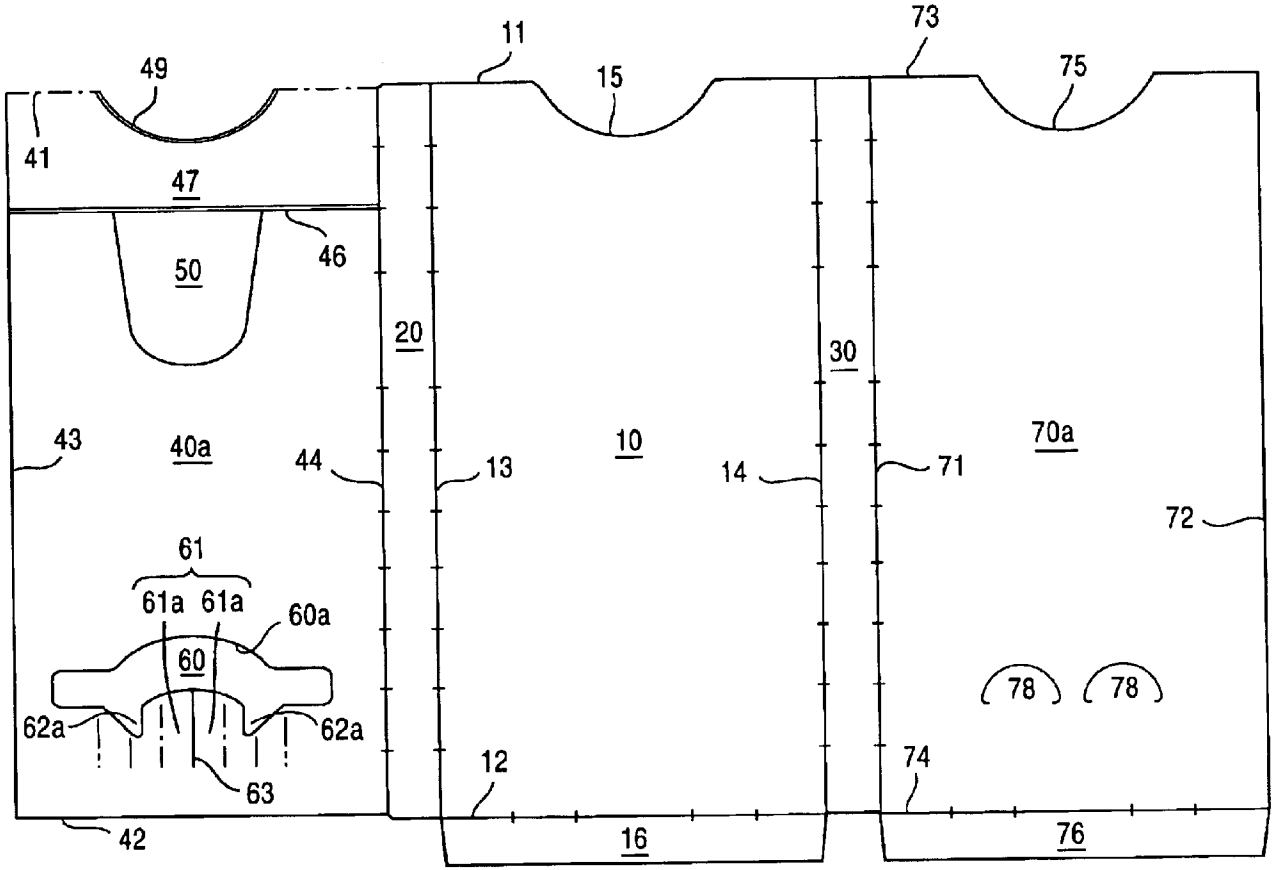
FIG. 12 is a top view of the package showing the second extension panel folded over a second panel of the outer sleeve of FIG. 11.
Figure 13:
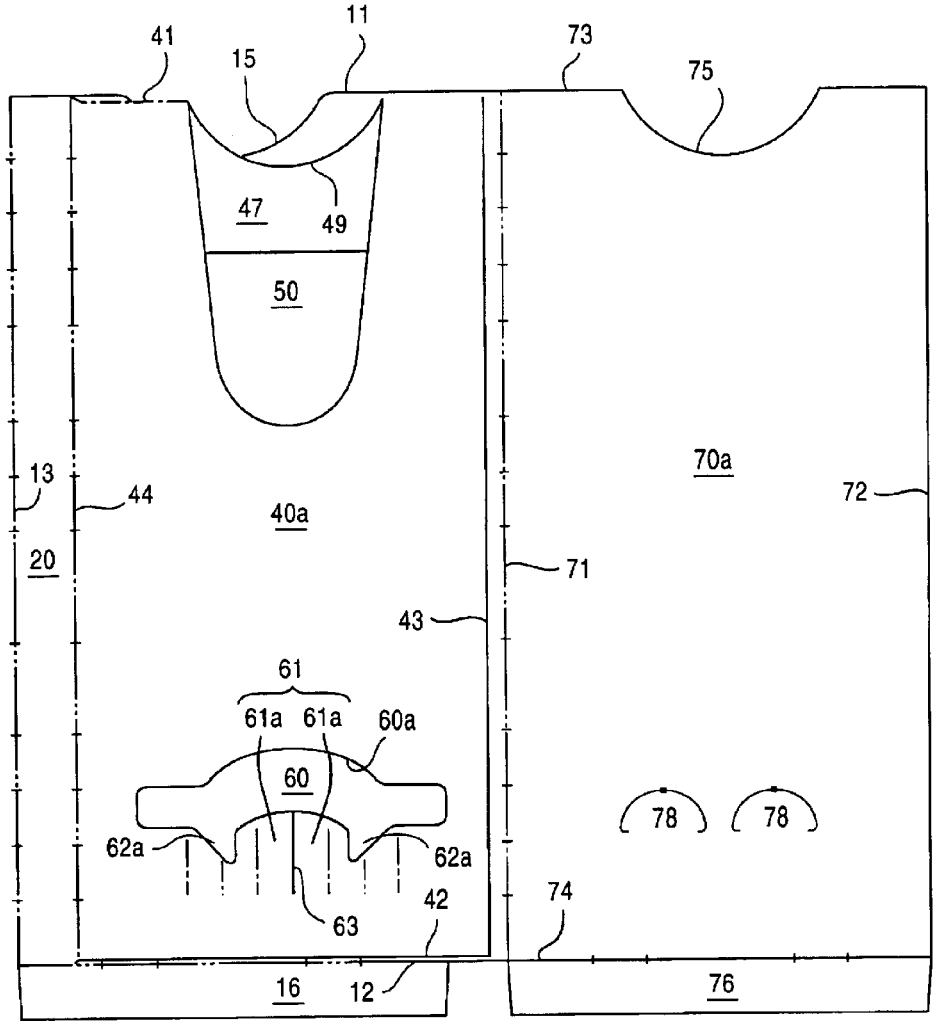
FIG. 13 is a top view of the package showing the second panel folded over a first panel of the outer sleeve of FIG. 12.
Figure 14:
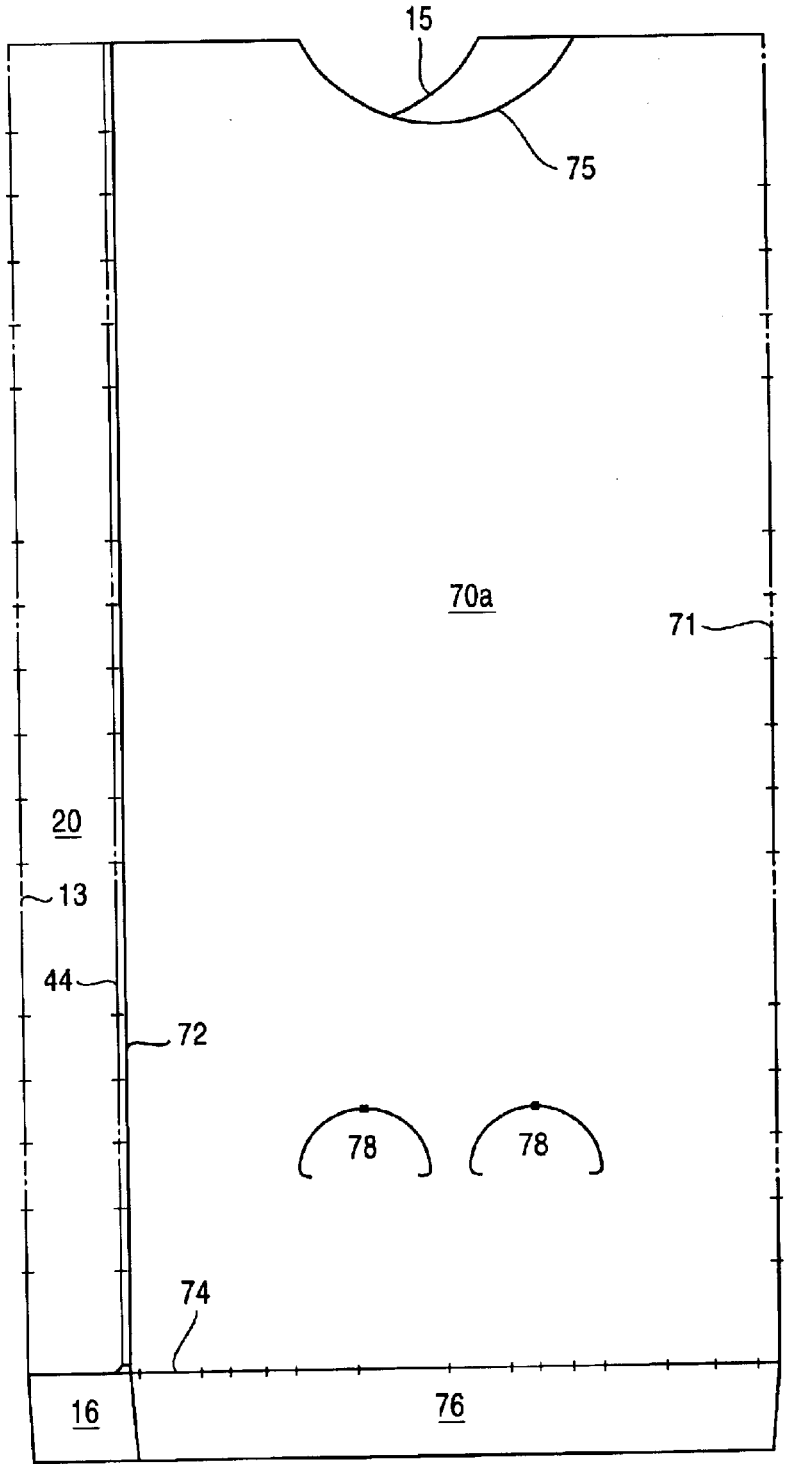
FIG. 14 is a top view of the package showing the third panel folded over the second panel of the outer sleeve of FIG. 13.
Figure 15:
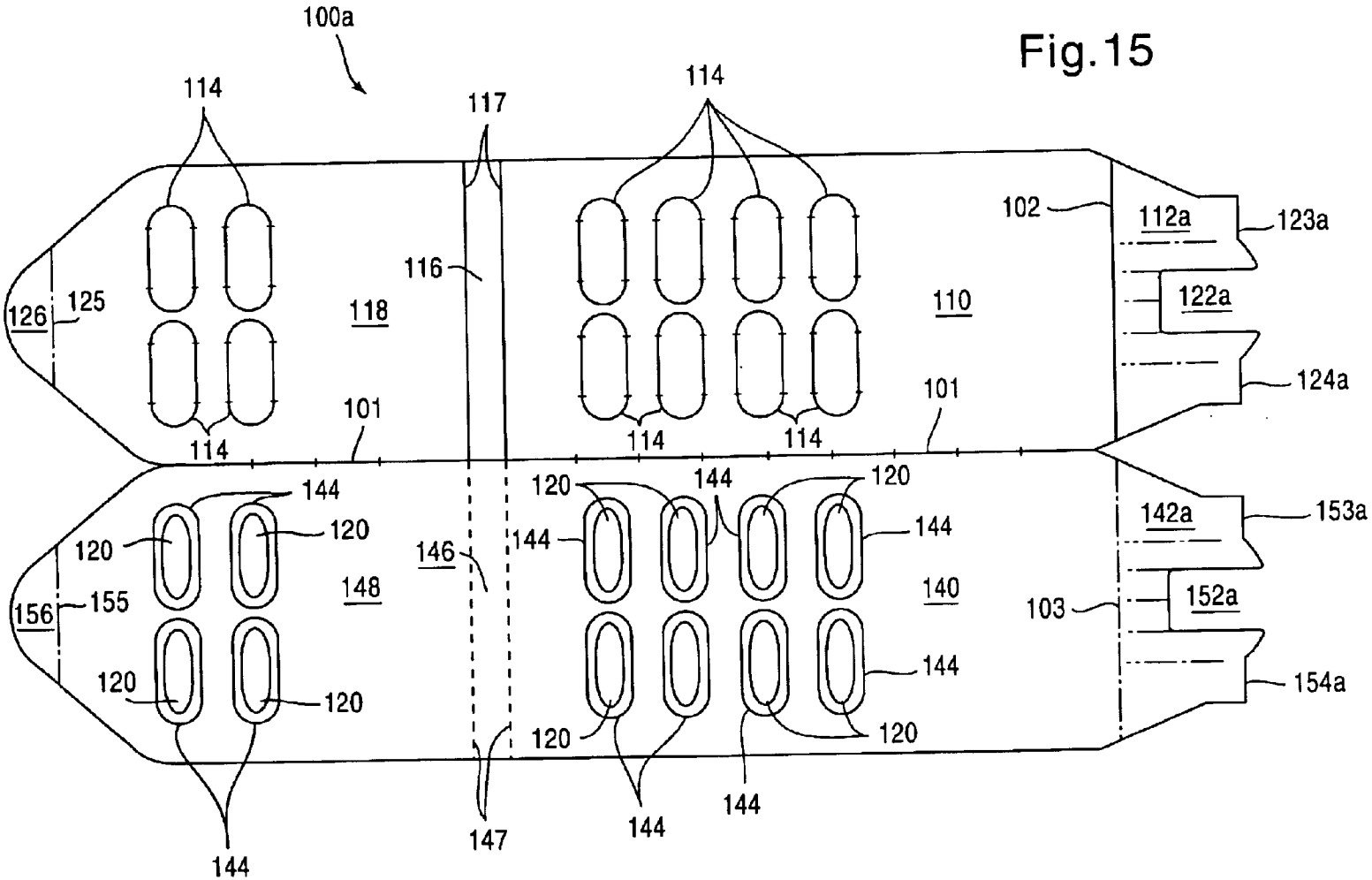
FIG. 15 is a top view of the disassembled slide card of the package according to a second embodiment of the invention.
Figure 16:
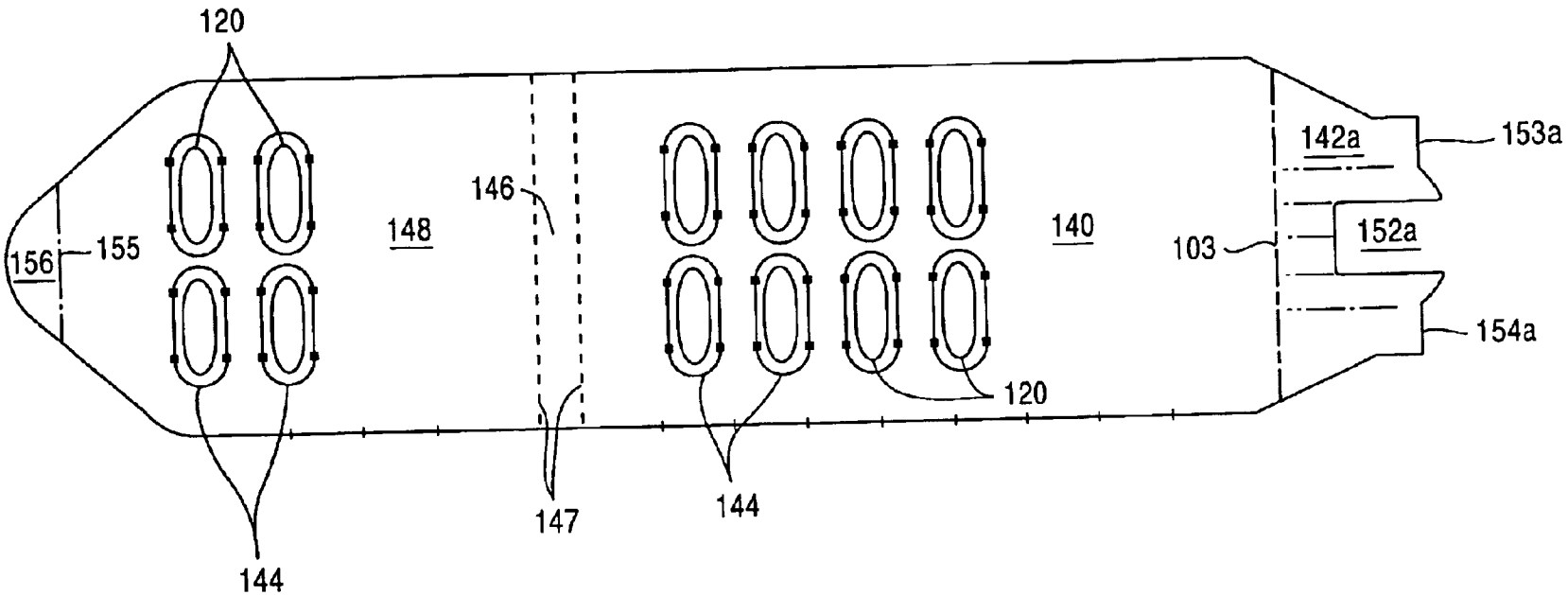
FIG. 16 is a top view of the of the slide card with a second slide panel folded over a first slide panel of the slide card of FIG. 15.
Figure 17:
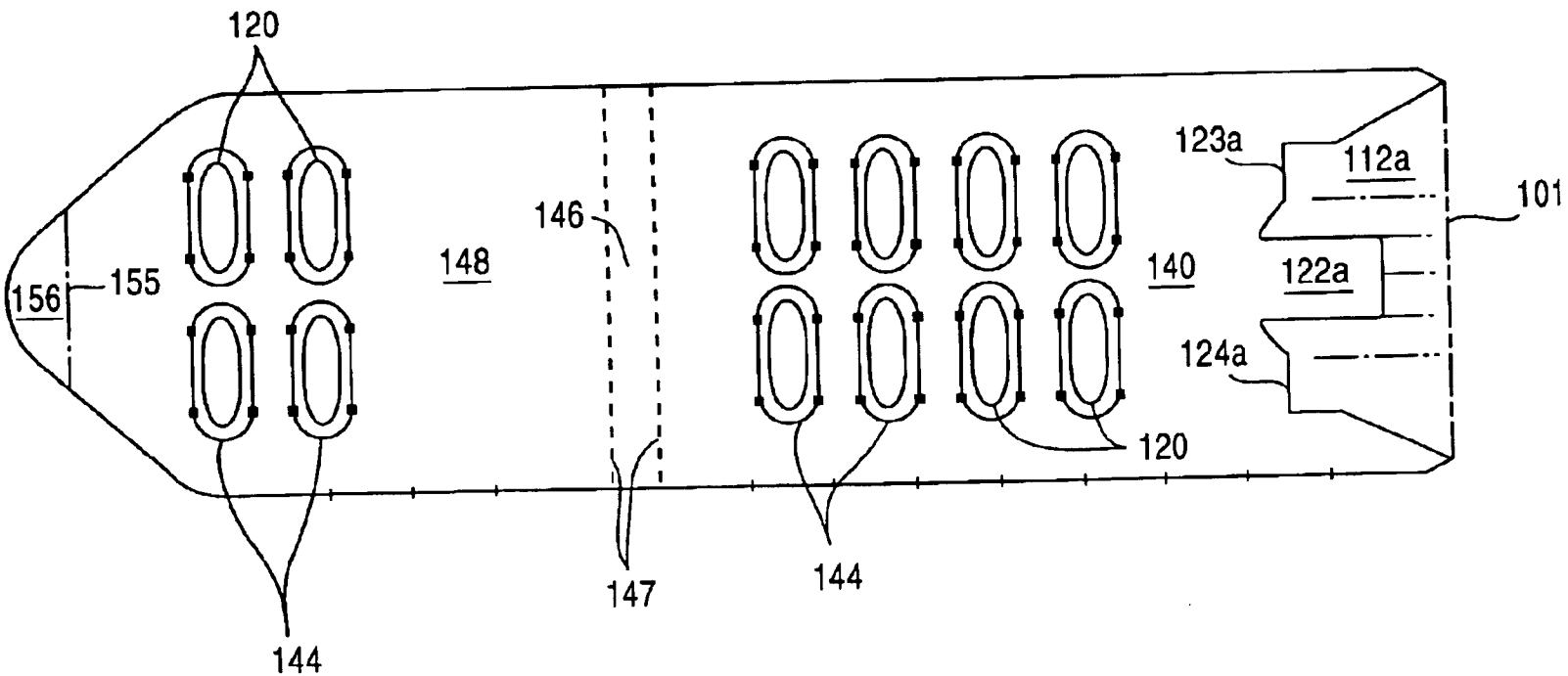
FIG. 17 is a top view of the slide card with a first end flap folded over the first slide panel of the slide card of FIG. 16.
Figure 18:
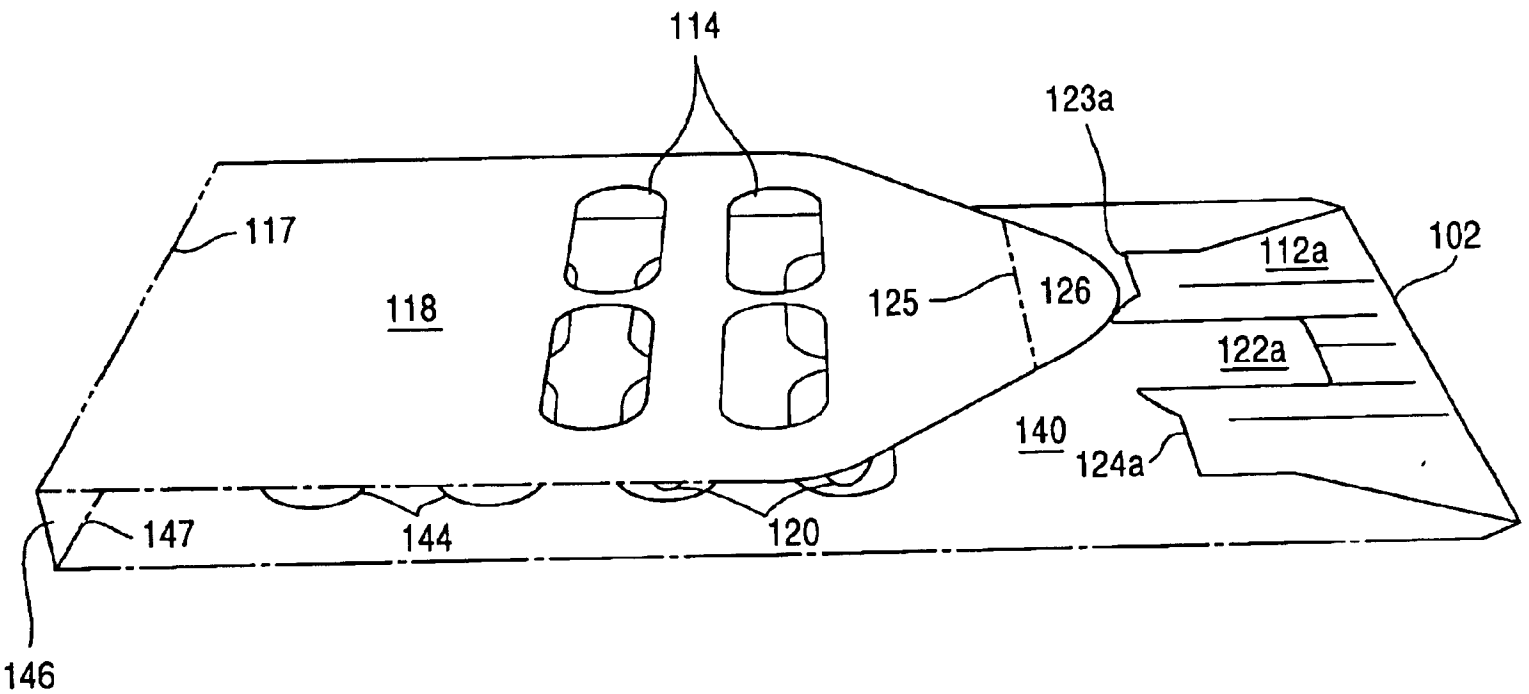
FIG. 18 is a top view of the slide card with a second end flap folded over the first slide panel of the slide card of FIG. 17.

FIG. 9 shows the completed structure of the inner slide card 100 after the third side panel 118 is folded over score line 117 to overlap at least a portion of the second side panel 140. It will be understood that when the slide card 100 is inserted into the outer sleeve 1, the score line 117 and perforated line 147 of the slide card 100 are disposed in the vicinity of the cut away 75 of the outer sleeve 1. Likewise, the score lines 102 and 103 of the slide card 100 are disposed in the vicinity of the bottom edge 12, 42, and 74 of the outer sleeve 1.

The inventive package includes a lock and release mechanism that includes the aperture 77, cut away 60, node 61, legs 62 and 62, and bifurcated end flaps 112 and 142. Thus, when the slide card 100 is substantially inserted into the outer sleeve 1, the bifurcated engaging segments 123, 124 and 153, 154 of the end flaps 112 and 142, respectively, spring up and into the opening defined by the cut away 60 and are biased against the node 61. As such, if a user attempts to remove the slide card 100 from the outer sleeve, the engaging segments 123, 124 and 153, 154, respectively, engage an engaging surface 60a formed by the cut away 60 and prevent the slide card 100 from sliding within the outer sleeve 1.

To disengage the engaging segments 123, 124 and 153, 154, the user directly depresses the node 61 through the aperture 77. Because the end flaps 112 and 142 are bifurcated, the only way to disengage the engaging segments 123, 124 and 153, 154, respectively, from the engaging surface 60*a* of the cut away 60 is by directly depressing the cut line 122 and throat region 152 of the end flaps 112 and 142, respectively. As described above, the lateral diameter AD of the aperture 77 is less than the lateral distance NW between parallel legs 62, 62 that define the node 61, i.e., NW>AD. As a result, the aperture 77 and node 61 are positioned directly above throat 122 and 142 regions.

Accordingly, the only way to directly depress the throat regions 122 and 142 is by pushing directly on the node 61 through aperture 77. The above described structural arrangement prevents the unintentional disengagement of the engaging segments 123, 124 and 153, 154 from the engaging segment 60*a* of the cut away 60. Once the depressed node 61 is driven downward and disengages the engaging segments 123, 124, and 153, 154 from the engaging surface 60*a* of the cut away 60, the slide card 100 can slide within the outer sleeve 1.

However, it should be noted that the slide card 100 cannot be completely removed from the outer sleeve as the engaging segments 123, 124 and 153, 154 are caught and retained by cut away 49 and 51 of folded over extension panels 47 and 45, respectively. To access a particular, dose 120, a user may unfold the third panel 118 over score line 117 and push downward onto the package 144 storing the dose 120. As a result, the dose 120 will be pushed through a back surface of the package 144 and out of the package through a corresponding perforated hole 114.

A second embodiment of the invention will now be explained.

Referring to FIGS. 10–14, the outer sleeve 1*a* of the package is similar to the sleeve 1 described above with regards to the first embodiment. However, the node 61 and legs 62*a*, 62*a* of the second panel 40*a* are modified and the aperture 77 of the third panel 70 is replaced with a pair of release buttons 78, 78. Otherwise, similar features are identified with like reference numerals and the description of such similar features is omitted to avoid redundancy.

As shown in FIGS. 10–13, the outer sleeve 1*a* for the package of the second embodiment also includes a second cut away 60 formed in a region near the bottom edge 42 of the second panel 40*a*. However, the pair of legs 62*a*, 62*a* which define the node 61 and prevent the entire length of the node 61 from deflecting are formed by elongations that are oblique relative to the bottom edge 42. Furthermore, the node 61 of the second embodiment is bifurcated by a cut line 63 into first and second node portions 61*a*, 61*a*. In other words, the node 61 of the second embodiment is defined by inclined legs 62*a*, 62*a* and a nodal cut line 63, which form first and second node portions 61*a*, 61*a*.

As shown in FIGS. 10–14, the third panel 70*a* of the outer sleeve 1*a* in this embodiment is substantially similar to the third panel 70 of the outer sleeve 1 in the first embodiment. However, the aperture 77 is replaced with a pair of semicircular release buttons 78, 78, wherein each release button overlaps a corresponding leg 62*a*, 62*a* and node portion 61*a*, 61*a*. The remaining features of the sleeve 1*a* and manner of assembly are substantially similar to the sleeve described in the previous embodiment. As such, the discussion of the similar features and manner of assembly is omitted herefrom to avoid redundancy.

As shown in FIGS. 15–18, the inner sleeve card 100*a* of the second embodiment includes end flaps 112*a* and 142*a* that are bifurcated by a throat 122*a* and 152*a*, respectively, into engaging segments 123*a*, 124*a* and 153*a*, 154*a*, respectively. At least a portion of throats 122*a* and 152*a*, which are of equal width and length, and a corresponding pair of engaging segments 123*a*, 154*a* and 124*a*, 153*a* of folded over first and second side panels 110 and 140, respectively, are each overlapped by one of the first and second node portions 61*a*, 61*a* when the fully assembled slide card 100*a* is inserted into the fully assembled outer sleeve 1*a*. As explained above, a region of each node portion 61*a*, 61*a* is overlapped by one of the release buttons 78, 78.

The inventive package includes a lock and release mechanism that includes the release buttons 78, 78, cut away 60, bifurcated node 61 with node portions 61*a*, 61*a*, inclined legs 62*a* and 62*a*, and bifurcated end flaps 112*a* and 142*a*. Thus, when the slide card 100*a* is substantially inserted into the outer sleeve 1*a*, the bifurcated engaging segments 123*a*, 124*a* and 153*a*, 154*a* of the end flaps 112*a* and 142*a*, respectively, spring up and into the opening defined by the cut away 60 and are biased against the node 61 (61*a*, 61*a*). As such, if a user attempts to remove the slide card 100*a* from the outer sleeve 1*a*, the engaging segments 123*a*, 124*a* and 153*a*, 154*a*, respectively, engage the engaging surface 60*a* formed by the cut away 60 and prevent the slide card 100*a* from sliding within the outer sleeve 1*a*.

To disengage the engaging segments 123*a*, 124*a* and 153*a*, 154*a* from the engaging surface 60*a* of the cut away 60, the user may first depress one of the release buttons 78. The depressed release button 78 in turn depresses a corresponding one of the node portions 61*a*, which results in a corresponding pair of engaging segments 123*a* and 154*a* or 124*a* and 153*a* of the overlapping flap ends 112*a* and 142*a* disengaging from the engaging surface 60*a* of the cut away 60. The user repeats this step with the other release button 78, remaining node portion 61*a*, and remaining pair of engaging segments 124*a* and 153*a* or 123*a* and 154*a* to fully release or disengage the engaging segments 123*a*, 124*a* and 153*a*, 154*a*, respectively, from the engaging surface 60*a* of the cut away 60.

Of course, the user may also depress both release buttons 78, 78 simultaneously, rather than sequentially as described above, in order to release or disengage the engaging segments 123*a*, 124*a* and 153*a*, 154*a* from the engaging surface 60*a* of the cut away 60.

Once the depressed node portions 61*a*, 61*a* are driven downward and disengage the engaging segments 123*a*, 124*a*, and 153*a*, 154*a* from the engaging surface 60*a* of the cut away 60, the slide card 100*a* can slide within the outer sleeve 1*a*. However, as in the first embodiment described above, it should be noted that the slide card 100*a* cannot be completely removed from the outer sleeve 1*a* as the engaging segments 123*a*, 124*a* and 153*a*, 154*a* are caught and retained by cut away 49 and 51 of folded over extension panels 47 and 45, respectively. A user may gain access to the dose 120 in a manner similar to that described above with regards to the first embodiment.

Many modifications may be made to adapt the teachings of the package of this invention to particular situations or materials without departing from the scope thereof.

Figure 19:
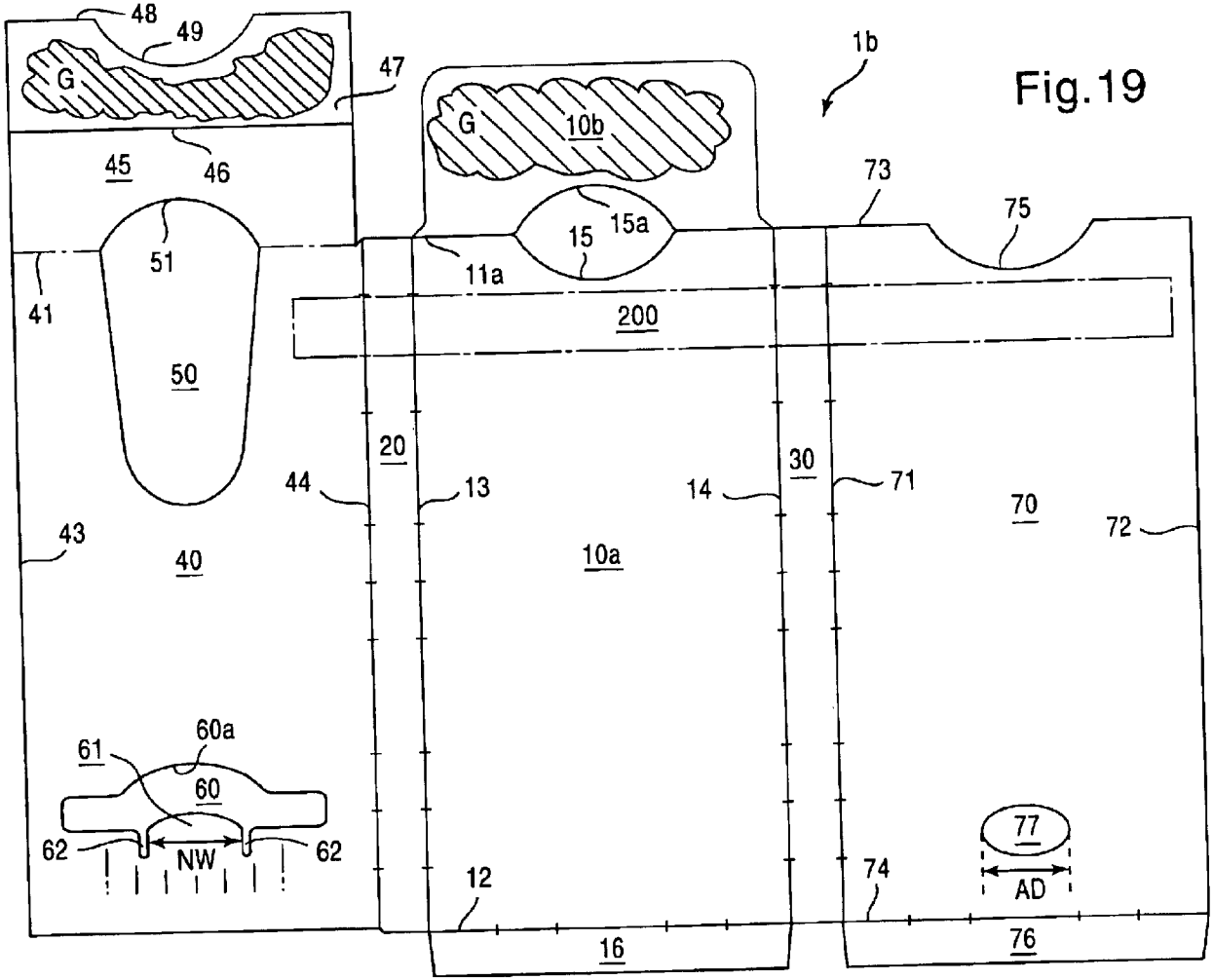
FIG. 19 is a top view of a disassembled outer sleeve of the package according to a third embodiment of the invention.

For example, as shown in FIG. 19, in a third embodiment of the outer sleeve 1*b* of the first embodiment, the outer sleeve 1 can be modified to include an extension panel 10*b* having a cut away 15*a* and extending away from score line 11*a* of the first panel 10*a*. The extension panel 10*b* may include an adhesive region G with an adhesive provided thereon. The adhesive may be any well known or later developed adhesive, such as, for example only, glue. The extension panel 10*b* would then be folded over score line 11*a* and adhered to the first panel 10*a* to provide additional rigidity to the outer sleeve 1*b* when fully assembled.

Figure 20:
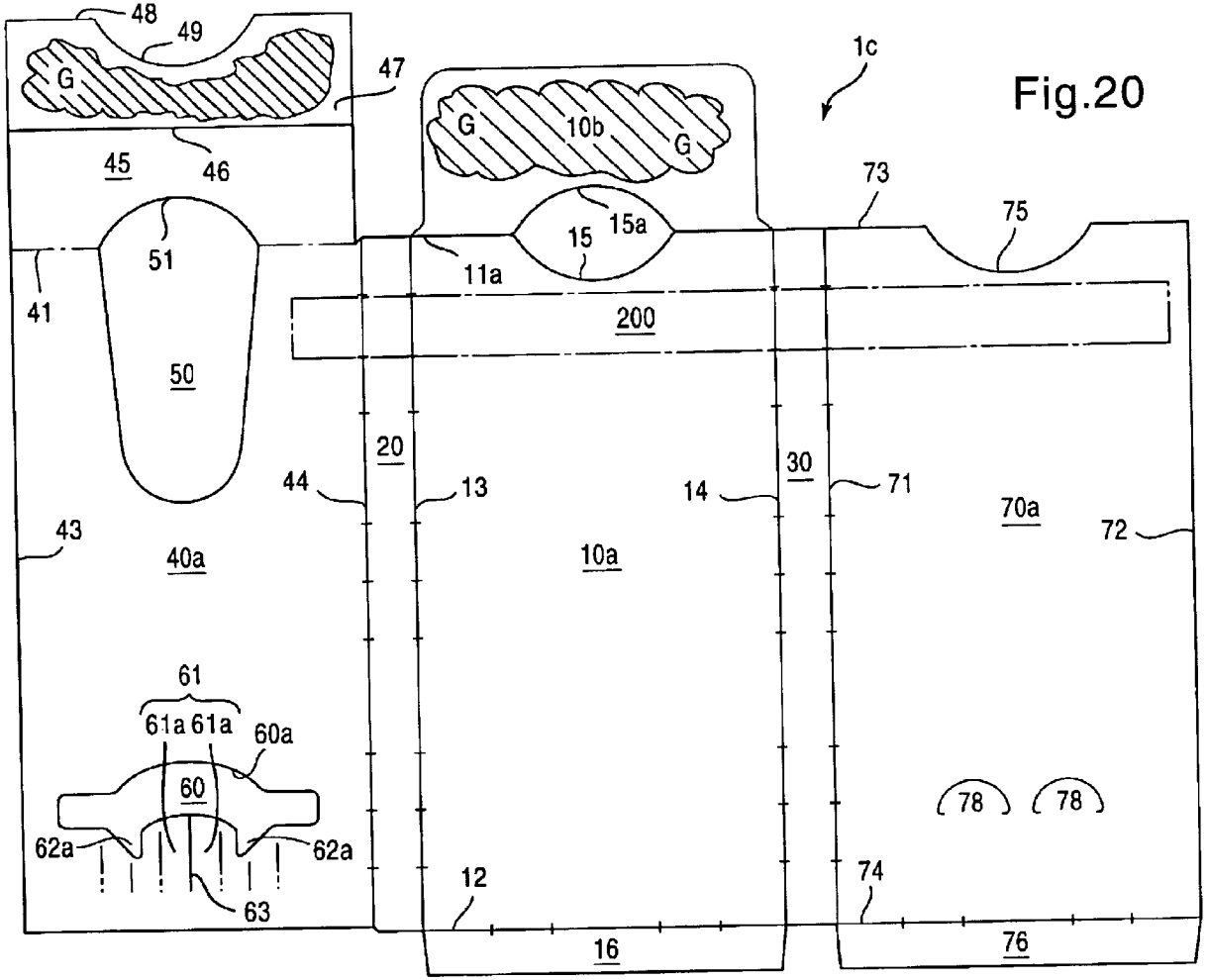
FIG. 20 is a top view of a disassembled outer sleeve of the package according to a fourth embodiment of the invention.

FIG. 20 shows a fourth embodiment of the outer sleeve 1*c* of the second embodiment wherein the outer sleeve 1*a* is similarly modified.

Furthermore, the outer sleeve 1, 1*a*, 1*b*, and 1*c* may include tear resistant material 200 that can be adhered to or laminated onto the outer sleeve. FIGS. 19 and 20 illustrate the tear resistant material 200 is provided as a strip, but it should be noted that it is within the scope of the invention to provide the tear resistant material 200 such that the material 200 covers specific regions or completely covers all of the sleeve 1, 1*a*, 1*b*, and 1*c*.

It is to be understood that the purpose of the outer sleeve 1, 1*a*, 1*b*, and 1*c* is to house the inner slide card 100, 100*a*. In addition, the outer sleeve 1, 1*a*, 1*b*, and 1*c* can be formed using a number of conventional techniques that are standard to the folding carton industry. Also, the package can be sealed by conventional techniques to simulate a temper evident like presence.

It is also to be understood that the purpose of the inner slide card 100, 100*a* is to retain unit dose packaging within the outer sleeve 1, 1*a*, 1*b*, and 1*c*. The inner slide card 100, 100*a* allows the end user to gain access to the unit does product 120 while pulling the inner slide card 100, 100*a* out until the slide card is stopped.

Accordingly, the invention should not be limited to the particular embodiments disclosed herein, but includes all embodiments within the spirit and scope of the disclosure.

We claim:

1. A lock and release mechanism of a unit dose package having an outer sleeve and a slide card configured to slidably fit within the outer sleeve, the outer sleeve having first, second, and third panels, wherein the second panel is foldable over the first panel and the third panel is foldable over the second panel, and the slide card having first, second, third, and fourth side panels, the first and third side panels are foldable over the second and fourth side panels, respectively, wherein the first side panel has an end flap extending away from a side edge and the second side panel has an end flap extending away from a side edge, the lock and release mechanism comprising:

a cut away formed in the second panel of the outer sleeve, the cut away having a pair of legs extending therefrom and defining a node therebetween;

a cut line formed in the end flap of the first side panel of the slide card, wherein the cut line bifurcates the end flap of the first side panel to define first and second engaging segments;

a throat region formed in the end flap of the second side panel of the slide card, wherein the throat region bifurcates the end flap of the second side panel to define first and second engaging segments, and wherein the first and second engaging segments of the bifurcated end flaps of the first and second side panels engage an engaging surface of the cut away to prevent the slide card from unintentionally sliding within the outer sleeve; and release means for releasing the slide card from a locked state, wherein the release means is formed in the third panel of the outer sleeve, and wherein the first and second engaging segments of the bifurcated end flaps of the first and second side panels are disengaged from the engaging surface of the cut away by depressing the node via the release means.

2. The lock and release mechanism according to claim 1, wherein the release means comprises an aperture.

3. The lock and release mechanism according to claim 2, wherein the aperture has a lateral diameter (AD) that is less than a lateral distance (NW) between the legs defining the node.

4. The lock and release mechanism according to claim 2, wherein the first and second engaging segments of the bifurcated end flaps of the first and second side panels are one of crown shaped, arcuate, rectangular, square, trapezoidal, and triangular.

5. The lock and release mechanism according to claim 3, wherein the legs are orthogonal relative to a bottom edge of the second panel of the outer sleeve.

6. The lock and release mechanism according to claim 3, wherein the aperture is disposed over the node and between the legs.

7. The lock and release mechanism according to claim 1, wherein the cut line formed in the end flap of the first side panel of the slide card has a width that is less than a width of the throat region formed in the end flap of the second side panel of the slide card.

8. The lock and release mechanism according to claim 1, wherein the cut line formed in the end flap of the first side panel of the slide card defines a throat region of the end flap of the first side panel, wherein the throat region formed in the end flap of the second side panel of the slide card has a width that is greater than or equal to a width of the throat region formed in the end flap of the first side panel of the slide card.

9. The lock and release mechanism according to claim 1, wherein the release means comprises a pair of release buttons.

10. The lock and release mechanism according to claim 9, wherein the legs are oblique relative to the bottom edge of the second panel of the outer sleeve.

11. The lock and release mechanism according to claim 10, wherein the node is bifurcated by a nodal cut line into first and second node portions.

12. The lock and release mechanism according to claim 11, wherein each release button of the pair of release buttons is disposed to overlap a corresponding leg and a corresponding one of the first and second node portions.

13. The lock and release mechanism according to claim 12, wherein the pair of release buttons are depressed either one of sequentially or simultaneously.

14. The lock and release mechanism according to claim 9, wherein the cut line formed in the end flap of the first side panel of the slide card defines a throat region of the end flap of the first side panel and the throat region formed in the end flap of the first side panel of the slide card has a width that is equal to a width of the throat region formed in the end flap of the second side panel of the slide card.

15. The lock and release mechanism according to claim 9, wherein the first and second engaging segments of the bifurcated end flaps of the first and second side panels are one of crown shaped, arcuate, rectangular, square, trapezoidal, and triangular.

16. The lock and release mechanism according to claim 1, wherein a top edge of the first panel of the outer sleeve includes an extension panel extending away therefrom.

17. The lock and release mechanism according to claim 16, wherein the top edge is a score line about which the extension panel is foldable onto the first panel of the outer sleeve.

18. The lock and release mechanism according to claim 17, wherein the extension panel comprises an adhesive region provided thereon for adhering the extension panel onto the first panel of the outer sleeve.

19. The lock and release mechanism according to claim 1, wherein at least a portion of the first, second, and third panels of the outer sleeve comprise a tear resistant material.

* * * * *